US010639699B2

(12) United States Patent
Yasutomi et al.

(10) Patent No.: US 10,639,699 B2
(45) Date of Patent: May 5, 2020

(54) SHEARING METHOD

(71) Applicant: NIPPON STEEL AND SUMITOMO METAL CORPORATION, Tokyo (JP)

(72) Inventors: Takashi Yasutomi, Tokyo (JP); Shigeru Yonemura, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 91 days.

(21) Appl. No.: 16/076,639

(22) PCT Filed: Feb. 8, 2017

(86) PCT No.: PCT/JP2017/004631
§ 371 (c)(1),
(2) Date: Aug. 8, 2018

(87) PCT Pub. No.: WO2017/138576
PCT Pub. Date: Aug. 17, 2017

(65) Prior Publication Data

US 2019/0060973 A1 Feb. 28, 2019

(30) Foreign Application Priority Data

Feb. 8, 2016 (JP) ..... 2016-022173
Aug. 24, 2016 (JP) ..... 2016-163694

(51) Int. Cl.
*B21D 28/16* (2006.01)
*B21D 28/34* (2006.01)
*B21D 28/24* (2006.01)

(52) U.S. Cl.
CPC ..... *B21D 28/16* (2013.01); *B21D 28/34* (2013.01); *B21D 28/24* (2013.01)

(58) Field of Classification Search
CPC ..... B21D 28/16; B21D 28/24; B21D 28/34; Y10T 83/9428; Y10T 83/943; Y10T 83/9432; Y10T 83/9437; Y10T 83/9444
See application file for complete search history.

(56) References Cited

FOREIGN PATENT DOCUMENTS

JP 56-136235 A 10/1981
JP 57025225 A * 2/1982
(Continued)

OTHER PUBLICATIONS

English Translation of JP57025225. (Year: 1982).*
(Continued)

*Primary Examiner* — Jennifer B Swinney
(74) *Attorney, Agent, or Firm* — Birch, Stewart, Kolasch & Birch, LLP

(57) ABSTRACT

Provided is a shearing method which can produce a worked material having a sheared edge excellent in surface perpendicularity and surface properties with a good productivity while suppressing tool wear and damage. The method comprises a first shearing step of placing a first blank having first and second surfaces on a first die so that said second surface is arranged on said first die side, and shearing said first blank from said first surface toward said second surface in a sheet thickness direction of said first blank by a first punch arranged at said first surface side to obtain a first punched out material and first worked material; and a second shearing step of placing a second blank and (x) using said first punched out material as a second punch, (y) using said first worked material as a second die, or both thereof.

20 Claims, 26 Drawing Sheets

(56) References Cited

FOREIGN PATENT DOCUMENTS

| | | | | | |
|---|---|---|---|---|---|
| JP | 60166128 | A | * | 8/1985 | ..... B21D 28/16 |
| JP | 4-47821 | U | | 4/1992 | |
| JP | 2002-321021 | A | | 11/2002 | |
| JP | 2003-162133 | A | | 6/2003 | |
| JP | 2006-82099 | A | | 3/2006 | |
| JP | 2008-18481 | A | | 1/2008 | |
| JP | 2009-51001 | A | | 3/2009 | |
| JP | 2009-178729 | A | | 8/2009 | |
| JP | 2010-36195 | A | | 2/2010 | |
| JP | 2011-218373 | A | | 11/2011 | |
| JP | 2012-115894 | A | | 6/2012 | |
| JP | 2014-231094 | A | | 12/2014 | |

OTHER PUBLICATIONS

English Translation of JP60166128. (Year: 1985).*
Nakamura et al., "A Study of Shaving Press Process," Plasticity and Processing, vol. 4, No. 29, Jun. 1963, pp. 387-395, with an English abstract.
Written Opinion of the International Searching Authority and English translation (PCT/ISA/237) for Application No. PCT/JP2017/004631, dated Apr. 18, 2017.
International Search Report for PCT/JP2017/004631 dated Apr. 18, 2017.

* cited by examiner

SHEARING METHOD

TECHNICAL FIELD

The present disclosure relates to a shearing method for shearing a blank, more particularly relates to a shearing method able to secure a sheared edge with excellent surface perpendicularity and surface properties and to suppress tool wear and damage when shearing a metal member to be used in automobiles, household electrical appliances, building structures, ships, bridges, construction machinery, various plants, penstocks, etc.

BACKGROUND ART

Shearing is made much use of for manufacture of the metal members used in automobiles, household electrical appliances, building structures, ships, bridges, construction machinery, various plants, penstocks, etc. FIGS. 1 and 2 schematically show modes of this shearing. FIG. 1 schematically shows the mode of shearing for forming a hole in a blank, while FIG. 2 schematically shows the mode of shearing for forming an open cross-section in a blank.

In the shearing shown in FIG. 1, a blank 10 is placed on a die 40 (below, also referred to as a "first blank") and a punch 90 is pushed into the blank 10 in a sheet thickness direction 90*a* to form a hole in the blank 10. In the shearing shown in FIG. 2, a blank 10 is placed on a die 40 and similarly a punch 90 is pushed into the blank 10 in the sheet thickness direction 90*a* to form an open cross-section in the blank 10.

Referring to FIG. 3 and FIG. 4, the shape and shaping mechanism of the sheared edge formed by the mode shown in FIG. 1 or FIG. 2 are shown. FIG. 3 shows a cross-sectional schematic view of a sheared edge 19 of a worked material 12 formed by shearing, while FIG. 4 shows a cross-sectional schematic view of shearing using a punch 90, die 40, and holder 50 for obtaining a punched out material 11 and worked material 12. The sheared edges of the punched out material 11 and worked material 12, usually, as shown in FIGS. 3 and 4, are comprised of shear droops 14, 14', burnished surfaces 15, 15', fracture surfaces 16, 16', and burrs 17, 17'. The shear droop 14 is formed at the punch side surface 18*a* of the sheared edge by the blank 10 being pushed in by the punch 90. As shown in FIGS. 1, 2, and 4, a clearance CL is provided between the punch 90 and die 40 so that the punch 90 and die 40 will not contact when the punch is pushed in the sheet thickness direction 90*a*. The clearance CL is necessary for securing a certain extent of distance for obtaining a contact margin of the punch 90 and die 40. When the punch 90 pushes the blank 10 in the sheet thickness direction 90*a* for shearing, the blank 10 is drawn into the clearance CL of the punch 90 and the die 40 whereby the blank 10 is locally pulled against and a burnished surface 15 is formed. The fracture surface 16 is formed by the blank 10 drawn into the clearance CL of the punch 90 and the die 40 being fractured. A burr 17 is formed at the die side surface 18*b* of the sheared edge when the blank 10 drawn into the clearance CL of the punch 90 and die 40 fractures and separates.

A sheared edge generally suffers from the problem of being inferior in surface properties, lower in fatigue strength, or lower in hydrogen embrittlement resistance compared with a worked surface formed by machining.

Numerous techniques have been proposed for solving the problem of a sheared edge. These techniques generally can be divided into ones which specially devise the structures of the punch and die to try to improve the surface perpendicularity and surface properties (fatigue strength etc.) of the sheared edge (for example, see PTLs 1 to 3) and ones which shave, coin, or otherwise process the sheared edge to try to improve the surface perpendicularity and surface properties (fatigue strength, hydrogen embrittlement resistance, etc.) (for example, see PTLs 4 to 6).

However, in the techniques specially devising the structures of the punch and die, there is a limit to the improvement of the surface perpendicularity and surface properties of the sheared edge. Further, in the techniques of processing the sheared edge, the productivity falls and the manufacturing costs rise by the amount of the increase of one step. Further, when working a high strength material, a tool easily suffers from wear, chipping, or other damage.

PTL 7 discloses a working method and working apparatus stacking shearing mechanisms of punches and dies and successively shearing metal sheets placed on the dies by pushing down the punches. In the working method and working apparatus of PTL 7, the productivity is improved and the manufacturing costs fall, but it is difficult to raise the surface perpendicularity and surface properties of the sheared edge of the worked material and the punch and/or die is damaged when shearing a high strength material.

NPTL 1 discloses post processing a punched out material blanked into a predetermined shape during which placing a blade at the die side and using a punch larger than the die to shave doubly stacked blanks in an overlaid blanking and shaving method. However, when blanking into a predetermined shape, the punch or die is damaged. On top of this, when shaving, the die with the blade may be damaged.

In the final analysis, in the prior art, it is difficult to shear a material while securing a sheared edge with excellent surface perpendicularity and surface properties and suppressing tool wear and damage.

CITATION LIST

Patent Literature

[PTL 1] Japanese Patent Publication No. 2009-051001A
[PTL 2] Japanese Patent Publication No. 2014-231094A
[PTL 3] Japanese Patent Publication No. 2010-036195A
[PTL 4] Japanese Patent Publication No. 2008-018481A
[PTL 5] Japanese Patent Publication No. 2011-218373A
[PTL 6] Japanese Patent Publication No. 2006-082099A
[PTL 7] Japanese Patent Publication No. 2012-115894A
[Nonpatent Literature]
[NPTL 1] Plasticity and Processing, "Research on Shaving and Press Forming" (Nakamura et al.), Vol. 4, No. 29 (1963), p. 387

SUMMARY OF THE INVENTION

Problems to be Solved by the Invention

The present disclosure, in view of the current state of the prior art, has as its technical problem to manufacture a worked material (product) having a sheared edge excellent in surface perpendicularity and surface properties with a good productivity while suppressing wear and damage of the tools (punch and die) and has as its object to the provision of a shearing method and shearing apparatus which solve this problem.

Means for Solving the Problems

The inventors engaged in in-depth studies on techniques for solving the above problem. As a result, they discovered that if using a punched out material obtained by punching a blank as a punch and/or using the punched worked material as the die, it is possible to manufacture a worked material (product) having a sheared edge excellent in surface perpendicularity and surface properties with a good productivity while suppressing tool wear and damage.

The present invention was made based on the above findings and has as its gist the following:

(1) A shearing method of shearing a blank by a die and a punch, characterized by comprising:

a first shearing step of placing, on a first die, a first blank having a first surface and a second surface on an opposite side to the first surface so that said second surface is arranged on said first die side, and shearing said first blank from said first surface toward said second surface in a sheet thickness direction of said first blank by a first punch arranged at said first surface side to obtain a first punched out material and a first worked material each having a first surface and a second surface corresponding to the first surface and the second surface of said first blank; and a second shearing step of placing a second blank and shearing said second blank to obtain a second punched out material and a second worked material by (x) using said first punched out material as a second punch, (y) using said first worked material as a second die, or (z) using said first punched out material as a second punch and using said first worked material as a second die.

(2) The shearing method according to (1) characterized in that, in said second shearing step, said first punched out material is placed so that the second surface of said first punched out material faces said second blank and so that the first surface of said first punched out material is arranged at said first punch side, and said first punched out material is used as said second punch to shear said second blank to obtain the second punched out material and the second worked material.

(3) The shearing method according to (1) characterized in that, in said second shearing step, said first punched out material is placed so that the first surface of said first punched out material faces said second blank and so that the second surface of said first punched out material is arranged at said first punch side, and said first punched out material is used as said second punch to shear said second blank to obtain the second punched out material and the second worked material.

(4) The shearing method according to any one of (1) to (3) characterized in that, in said second shearing step, said first worked material is placed so that the first surface of said first worked material faces said second blank and so that the second surface of said first worked material is arranged at said first die side, and said first worked material is used as said second die to shear said second blank to obtain the second punched out material and the second worked material.

(5) The shearing method according to any one of (1) to (3) characterized in that, in said second shearing step, said first worked material is placed so that the second surface of said first worked material faces said second blank and so that the first surface of said first worked material is arranged at said first die side, and said first worked material is used as said second die to shear said second blank to obtain the second punched out material and the second worked material.

(6) The shearing method according to any one of (1) to (5) characterized in that, in said second shearing step, a clearance between the punch used for said second blank and the die used for said second blank in a direction perpendicular to a sheet thickness direction of said second blank is about 0 mm.

(7) The shearing method according to any one of (1) to (6) characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

(8) A shearing apparatus having a punch and a die for shearing a blank and shearing said blank to obtain a punched out material and a worked material, the shearing apparatus comprising a first punch and a first die, characterized in that said shearing apparatus further comprises:

a punched out material reutilization mechanism using a first punched out material obtained by shearing a first blank by said first punch and first die as a second punch when shearing a second blank, a worked material reutilization mechanism using a first worked material obtained by shearing a first blank by said first punch and first die as a second die when shearing a second blank, or a punched out material reutilization mechanism using a first punched out material obtained by shearing a first blank by said first punch and first die as a second punch when shearing a second blank and a worked material reutilization mechanism using a first worked material obtained by shearing a first blank by said first punch and first die as a second die when shearing a second blank.

Effect of the Invention

According to the present disclosure, it becomes possible to produce a worked material (product) having a sheared edge excellent in surface perpendicularity and surface properties with a good productivity while suppressing tool wear and damage.

DESCRIPTION OF EMBODIMENTS

The shearing method of the present disclosure (below, also referred to as "the present method") and shearing apparatus of the same (below, also referred to as "the present apparatus") have as their basic idea to use at least one of the punched out material and worked material obtained by shearing a blank as at least one tool among the punch and die in the shearing of the next blank.

The present method is a shearing method for shearing a blank by a die and a punch, and comprises a first shearing step and a second shearing step. In the first shearing step, a first blank having a first surface and a second surface at the opposite side to the first surface is placed on a first die so that the second surface is placed on the first die side. Next, the first blank is sheared from the first surface toward the second surface in the sheet thickness direction of the first blank by a first punch arranged at the first surface side to obtain a first punched out material and a first worked material each having a first surface and a second surface corresponding to the first surface and the second surface of the first blank. At the second shearing step, a second blank is placed and (x) the first punched out material is used as a second punch, (y) the first worked material is used as a second die, or (z) the first punched out material is used as a second punch and the first worked material is used as a second die, to shear a second blank to obtain a second punched out material and a second worked material.

Below, the present method will be suitably explained based on the drawings.

In the present method, the first and second blanks are usually metal blanks able to be sheared. The first and second blanks may include nonmetallic blanks if able to be sheared. For example, they may also be laminated steel sheets including resin layers. The metal blanks able to be sheared may be ferrous or ferrous alloy metal sheets or nonferrous or nonferrous alloy metal sheets. The first and second blanks are preferably ferrous or ferrous alloy metal sheets, more preferably metal sheets having a 340 MPa class or more, more preferably 980 MPa class or more tensile strengths, still more preferably steel materials having the above tensile strengths. In metal sheets having 340 MPa class or more tensile strengths, in particular measures against fatigue fracture become necessary. In metal sheets having 980 MPa class or more tensile strengths, measures against hydrogen embrittlement cracks also become necessary. In particular, when the blank is a steel material, measures against hydrogen embrittlement cracks and fatigue fracture become important. The present method can be similarly used for shearing a third blank as explained later. The material of the third blank is similar to the materials of the first and second blanks.

Embodiment 1

Figure 5:
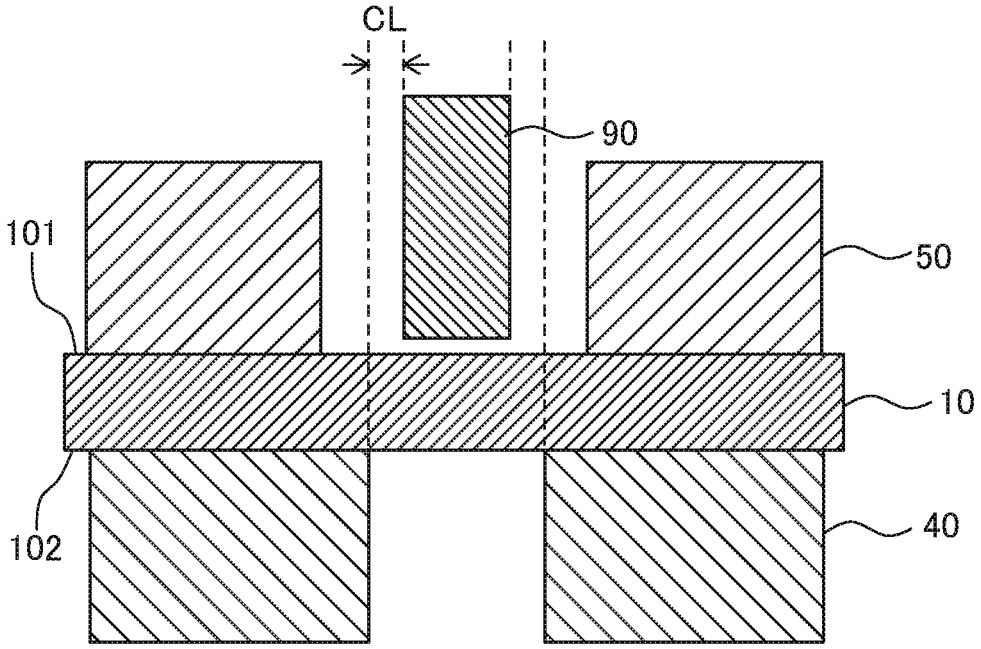
FIG. 5 is a cross-sectional schematic view showing an Embodiment 1 of shearing of the present disclosure for obtaining a first punched out material and a first worked material.
Figure 6:
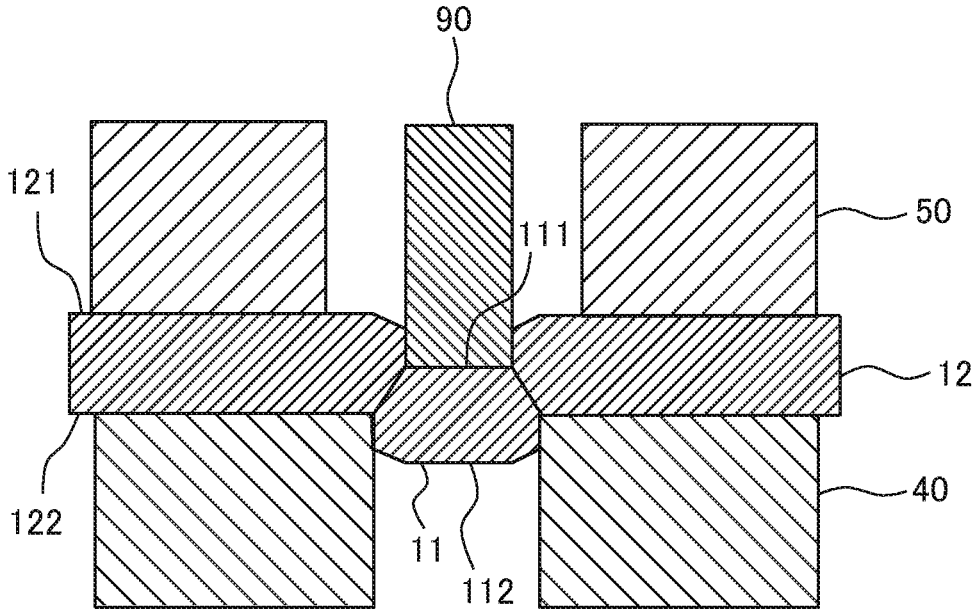
FIG. 6 is a cross-sectional schematic view showing an Embodiment 1 of shearing of the present disclosure for obtaining a first punched out material and a first worked material.
Figure 7:
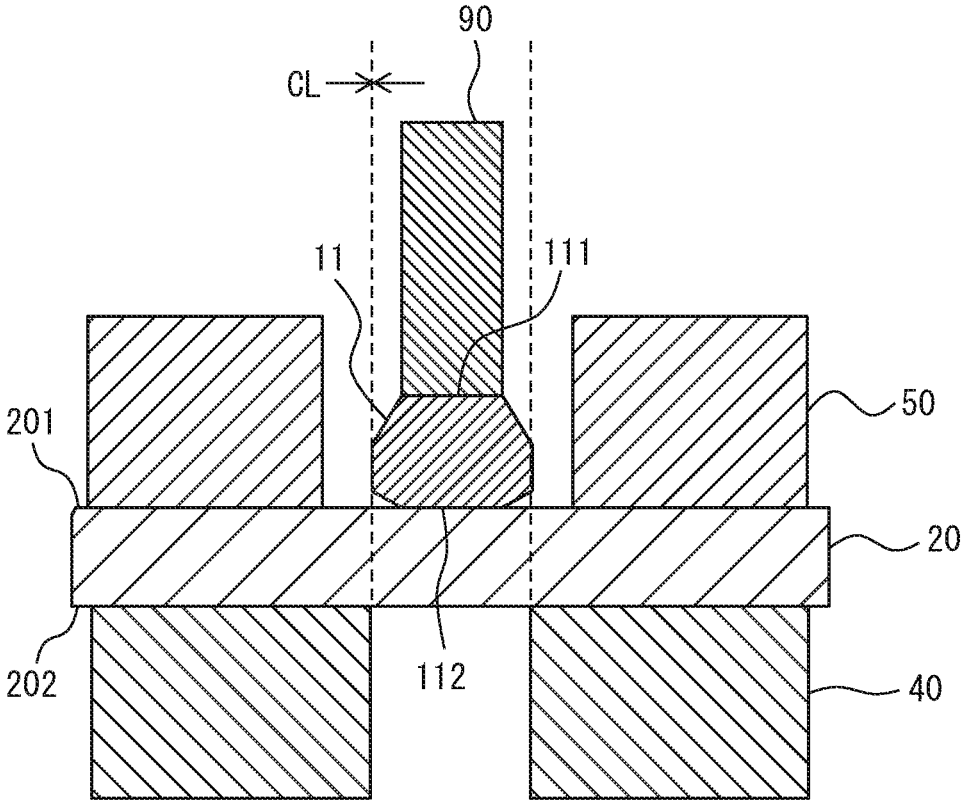
FIG. 7 is a cross-sectional schematic view showing an Embodiment 1 of shearing of the present disclosure for obtaining a second punched out material and a second worked material.
Figure 8:
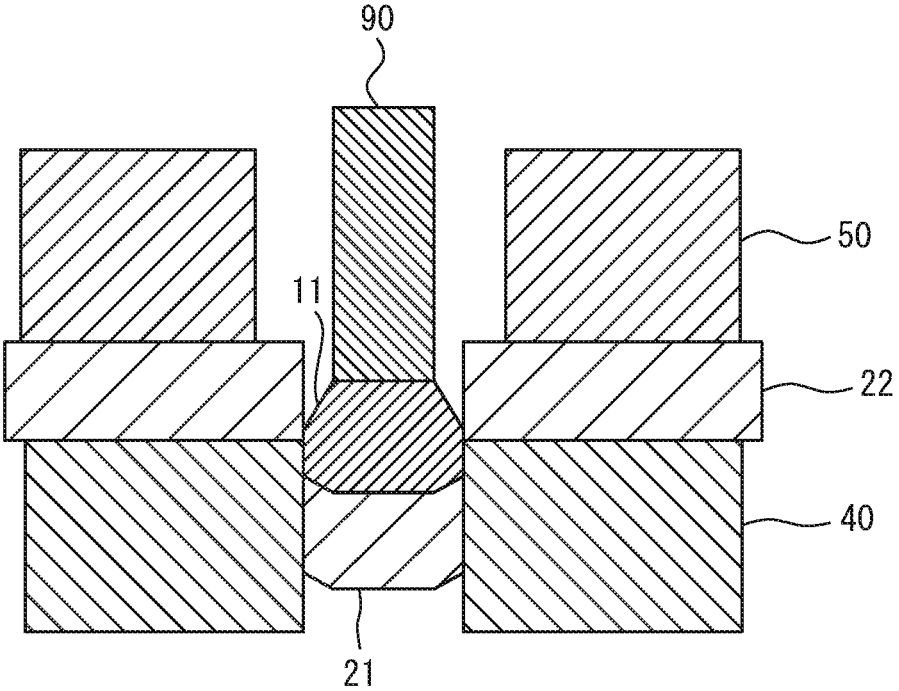
FIG. 8 is a cross-sectional schematic view showing an Embodiment 1 of shearing of the present disclosure for obtaining a second punched out material and a second worked material.

FIGS. 5 to 8 show one embodiment of the shearing of the present method. In the one embodiment of the shearing of the present method, the first shearing shown in FIGS. 5 and 6 (conventional shearing) is performed, then the second shearing shown in FIGS. 7 and 8 is performed.

In the first shearing shown in FIGS. 5 and 6, a first blank 10 having a first surface 101 and a second surface 102 on the opposite side is placed between a first die 40 and a first punch 90 so that the first surface is arranged on the first punch 90 side and the second surface 102 is arranged on the first die 40 side. The first punch 90 punches the first blank 10 from the first surface 101 toward the second surface 102 of the first blank 10 to thereby obtain a first punched out material 11 and a first worked material 12. The first punched out material 11 has a first surface 111 and a second surface 112 corresponding to the first surface 101 and the second surface 102 of the first blank 10. The first worked material 12 also has a first surface 121 and a second surface 122 corresponding to the first surface 101 and the second surface 102 of the first blank. A holder 50 holds down the first blank 10 from the first surface 101 side toward the first die 40 side to fasten the first blank 10 at the time of punching by the first punch 90. FIGS. 5 and 6 show the holder 50, but the holder 50 can be configured in any way. In the following explanation, the same is true unless particularly indicated otherwise.

In the second shearing shown in FIGS. 7 and 8, the first punched out material 11 punched out in the first shearing step is used as a second punch in the punched out state without changing its orientation. In more detail, the first punched out material 11 is placed between the first punch 90 and the second blank 20 so that the second surface 112 of the first punched out material 11 faces a predetermined punching location at the second blank 20 and the first surface 111 faces the first punch 90. From this state, the first punch 90 pushes down the first punched out material 11 as the second punch and punches the second blank 20 from the first surface 201 toward the second surface 202 of the second blank 20 to thereby obtain the second punched out material 21 and the second worked material 22. Here, the first punched out material having the second surface 112 at the second blank 20 side and having the first surface 111 at the first punch 90 side, that is, "the first punched out material in the punched out state", will also be referred to as the first punched out material 11 or the first noninverted punched out material 11.

In the second shearing step shown in FIGS. 7 and 8, when shearing the second blank 20 placed on the first die 40, the first noninverted punched out material 11 is placed at the scheduled punching location and used as a second punch to shear the second blank 20 and obtain a second punched out material 21 and a second worked material 22. The first noninverted punched out material 11 is work hardened when punching it by the first shearing step. Further, it is pushed in by the first punch 90, so even if the second blank 20 is the same material as the first blank 10, the first noninverted punched out material 11 can be used as the second punch to shear the second blank 20.

As shown in FIG. 7 by the broken line, in the second shearing step, the outside diameter of the first punched out material 11 used as the second punch and the inside diameter of the first die 40 are substantially the same. That is, at the second shearing step, the clearance CL between the outside diameter of the first punched out material 11 used as the second punch and the inside diameter of the first die 40 becomes smaller than the clearance CL between the outside diameter of the first punch 90 and the inside diameter of the first die 40. For this reason, at the second shearing step, the amount of the second blank 20 drawn into the clearance CL by the first punched out material 11 is decreased and the second worked material 22 can be given a sheared edge excellent in surface perpendicularity and surface properties. The second punched out material 21 as well, in the same way, can be given a sheared edge excellent in surface perpendicularity and surface properties. Further, since the first punched out material 11 is used as the second punch, it is possible to manufacture a worked material (product) with a good productivity while suppressing wear and damage of the tool (in the present embodiment, the first punch 90). The "surface perpendicularity" means the degree of perpendicularity of the sheared edge to the first surface and the second surface of the blank. In other words, it means the degree of parallelness to the sheet thickness direction of the blank. The "surface properties" mean the fatigue strength and hydrogen embrittlement resistance.

NPTL 1 discloses an overlaid blanking and shaving method placing a blade at the die side. As opposed to this, in the present method, a punched out material is used as the blade and the shearing is performed by coactions of the punched out material and die.

Normally, shearing is performed by setting the clearance CL of the punch and die (see "CL" of FIGS. 5 and 7) to the required clearance. In the second shearing shown in FIG. 7, the first punched out material 11 is used as the second punch, so the clearance between the first punched out material 11 used as the second punch and the first die 40 can be smaller than that of the shearing shown in FIG. 5, preferably can be made about 0 mm. For this reason, it is possible to punch out from the blank a hole of the same dimensions and shape as the punched out material used as the punch with a high precision and possible to obtain a worked material having a sheared edge excellent in surface perpendicularity and surface properties.

The clearance CL in the present method and the present apparatus, as shown in FIGS. 5 and 7, means the clearance in the direction perpendicular to the sheet thickness direction of the blank between the punched out material used as the first punch or the second punch and the worked material used as the first die or the second die. The clearance CL being about 0 mm means the clearance between the punch and die is preferably within ±1% of the sheet thickness, more preferably within ±0.5% of the sheet thickness, still more preferably within ±0.1% of the sheet thickness, still more preferably substantially 0.

Figure 1:
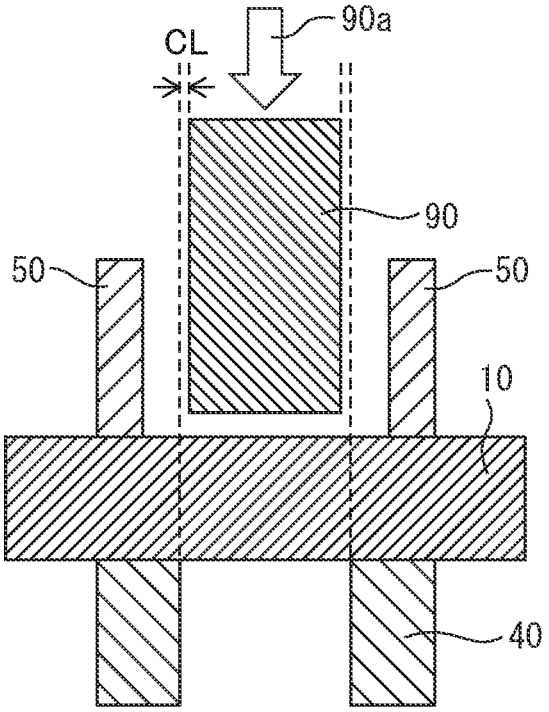
FIG. 1 is a cross-sectional schematic view showing a mode of shearing for forming a hole in a blank.
Figure 2:
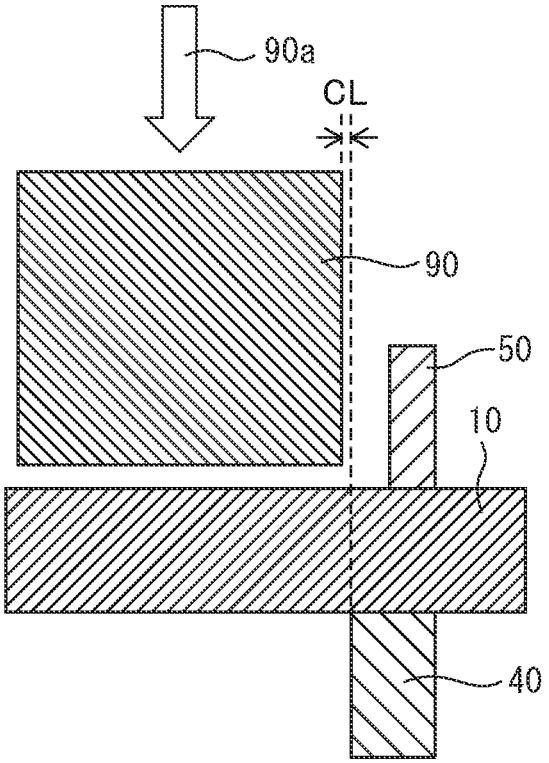
FIG. 2 is a cross-sectional schematic view showing a mode of shearing for forming an open cross-section in a blank.
Figure 3:
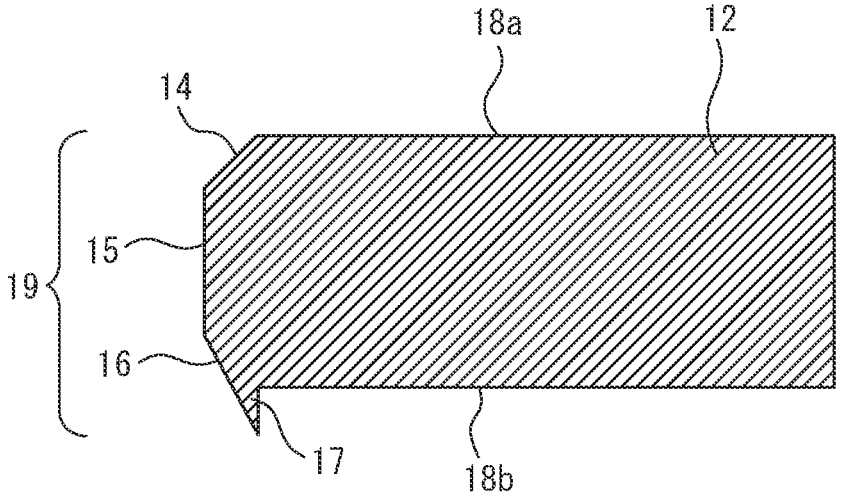
FIG. 3 is a cross-sectional schematic view of a sheared edge of a blank.
Figure 4:
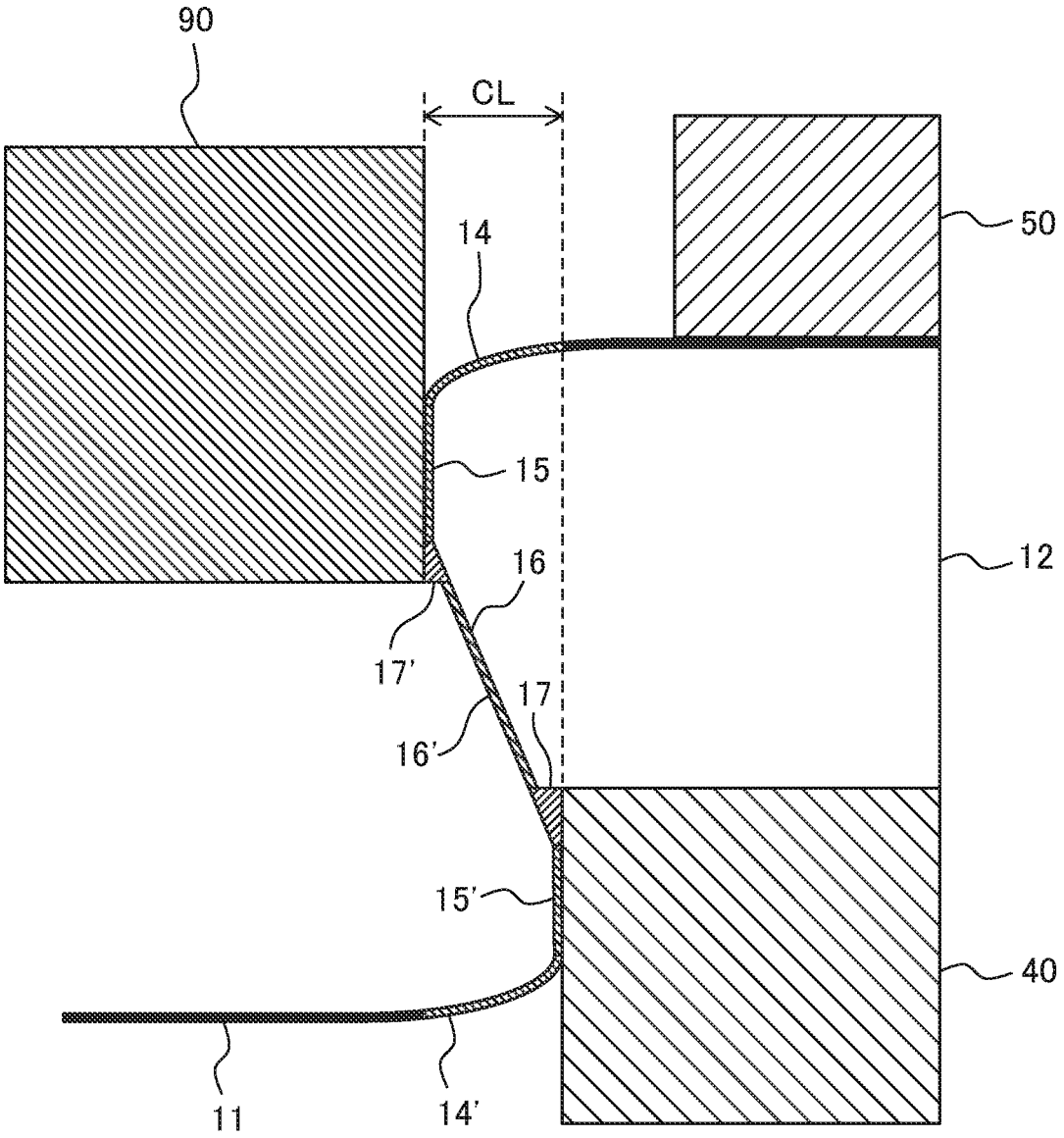
FIG. 4 is a cross-sectional schematic view of shearing for obtaining a punched out material and worked material.

Normally, as shown in FIG. 5, if the clearance CL is large, during shearing, tensile stress is generated at the location being sheared and a fracture surface (see numerals "16" and "16'" in FIGS. 3 and 4) where voids causing ductile fracture easily occur is formed.

On the other hand, as shown in FIG. 7, if the clearance CL is small, preferably if it is about 0 mm, during shearing, it becomes difficult for tensile stress to form at the location being sheared, formation of a fracture surface where voids causing ductile fracture easily occur is suppressed, and shearing becomes possible. The thus formed sheared edge has excellent surface perpendicularity, has excellent surface properties with suppressed residual tensile stress, and is excellent in hydrogen embrittlement resistance and fatigue characteristics.

Below, other embodiments will be explained. In the following explanations of the embodiments, common explanations of the first shearing will be omitted.

Embodiment 2

Figure 9:
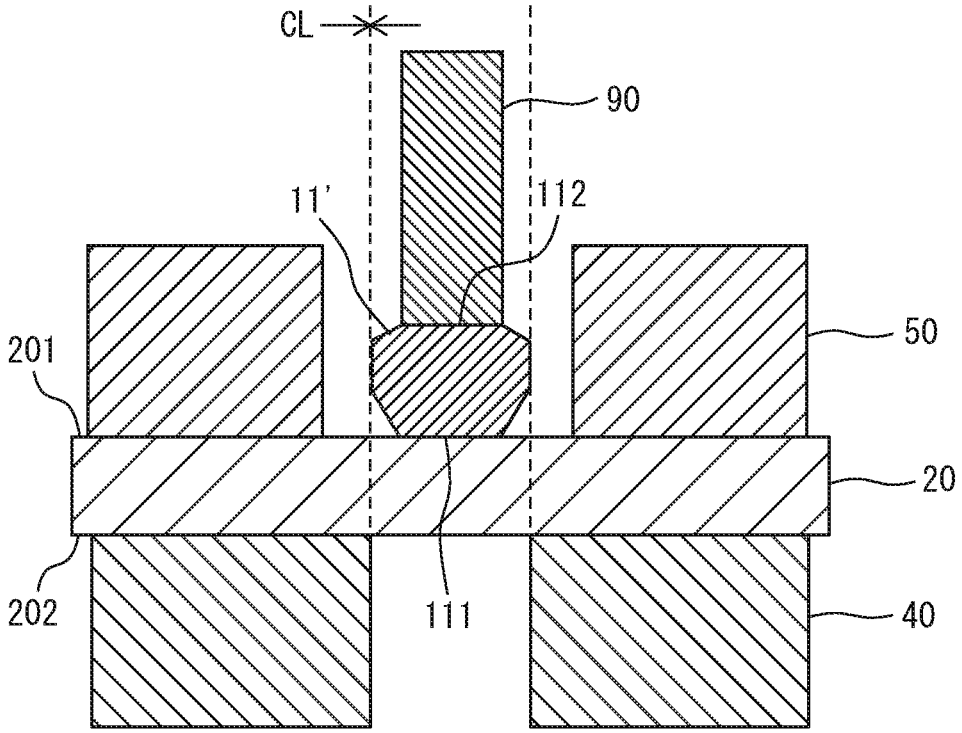
FIG. 9 is a cross-sectional schematic view showing an Embodiment 2 of the present method.
Figure 10:
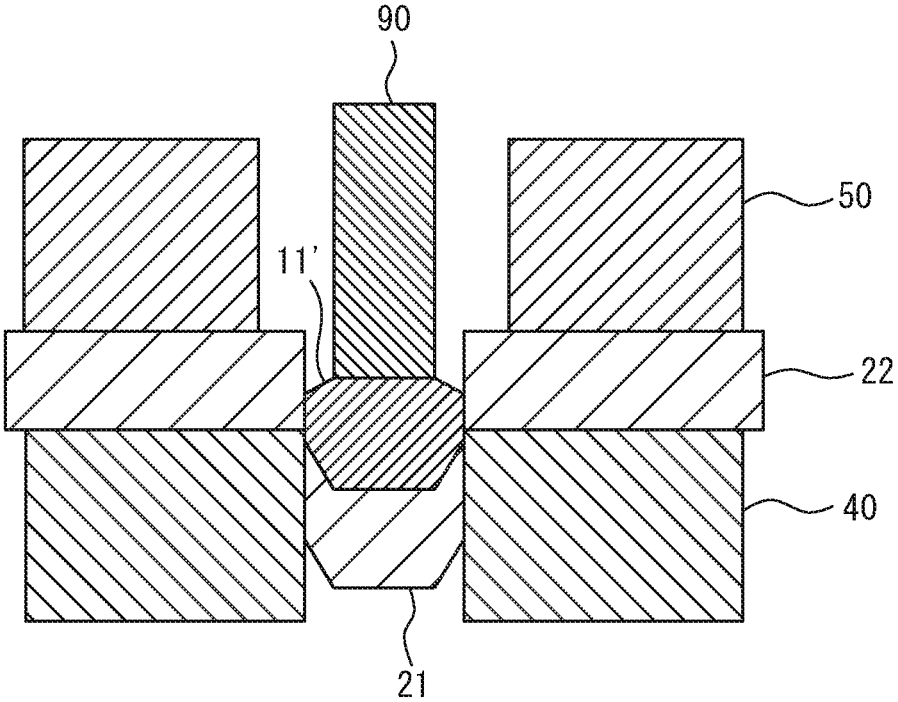
FIG. 10 is a cross-sectional schematic view showing an Embodiment 2 of the present method.

FIGS. 9 and 10 show another embodiment of the second shearing step in the shearing of the present method. The first punched out material 11 punched out at the first shearing step shown in FIG. 6 may be inverted from the punched out state and used as the second punch in the second shearing step. Here, the first punched out material having the first surface 111 at the second blank 20 side and the second surface 112 at the first punch 90 side, that is, the "first punched out material inverted from the punched out state", will also be referred to as the "first punched out material 11'" or the "first inverted punched out material 11'". In the second shearing step shown in FIGS. 9 and 10, the first punched out material 11 punched out in the first shearing step is inverted from the punched out state and used as the second punch. In more detail, the first inverted punched out material 11' is placed between the first punch 90 and the second blank 20 so that the first surface 111 faces the scheduled punching location at the second blank 20 and so that the second surface 112 faces the first punch 90. From this state, the first punch 90 pushes down the first inverted punched out material 11' as the second punch and punches the second blank 20 from the first surface 201 to the second surface 202 of the second blank 20 to thereby obtain the second punched out material 21 and the second worked material 22.

In the second shearing step shown in FIGS. 9 and 10, when shearing the second blank 20 placed on the first die 40, it is possible to place the first inverted punched out material 11' at the scheduled punching location and use it as the second punch to shear the second blank 20 to obtain the second punched out material 21 and the second worked material 22. The first inverted punched out material 11' is work hardened when punching it out at the first shearing step. Further, since it is pushed in by the first punch 90, even if the second blank 20 is the same material as the first blank 10, the first inverted punched out material 11' can be used as a second punch to shear the second blank 20.

As shown in FIG. 9, the first inverted punched out material 11' has the shape of the first noninverted punched out material 11 inverted from the blank 20. As shown by the broken line in FIG. 9, even when using the first inverted punched out material 11' as the second punch for shearing, in the same way as the Embodiment 1, the outside diameter of the first inverted punched out material 11' and the inside diameter of the first die 40 are substantially the same.

That is, in the present embodiment as well, the clearance CL between the outside diameter of the first inverted punched out material 11' and the inside diameter of the first die 40 becomes smaller than the clearance CL between the outside shape of the first punch 90 and the inside diameter of the first die 40, preferably becomes about 0 mm. For this reason, the amount of the second blank 20 drawn into the clearance CL by the first inverted punched out material 11' is decreased and the second worked material 22 can be given a sheared edge excellent in surface perpendicularity and surface properties. The second punched out material 21 similarly can be given a sheared edge excellent in surface perpendicularity and surface properties. Further, since the first inverted punched out material 11' is used as the second punch, it is possible to manufacture a worked material (product) with a good productivity while suppressing wear and damage of the tool (in the present embodiment, the first punch 90).

Embodiment 3

Figure 11:
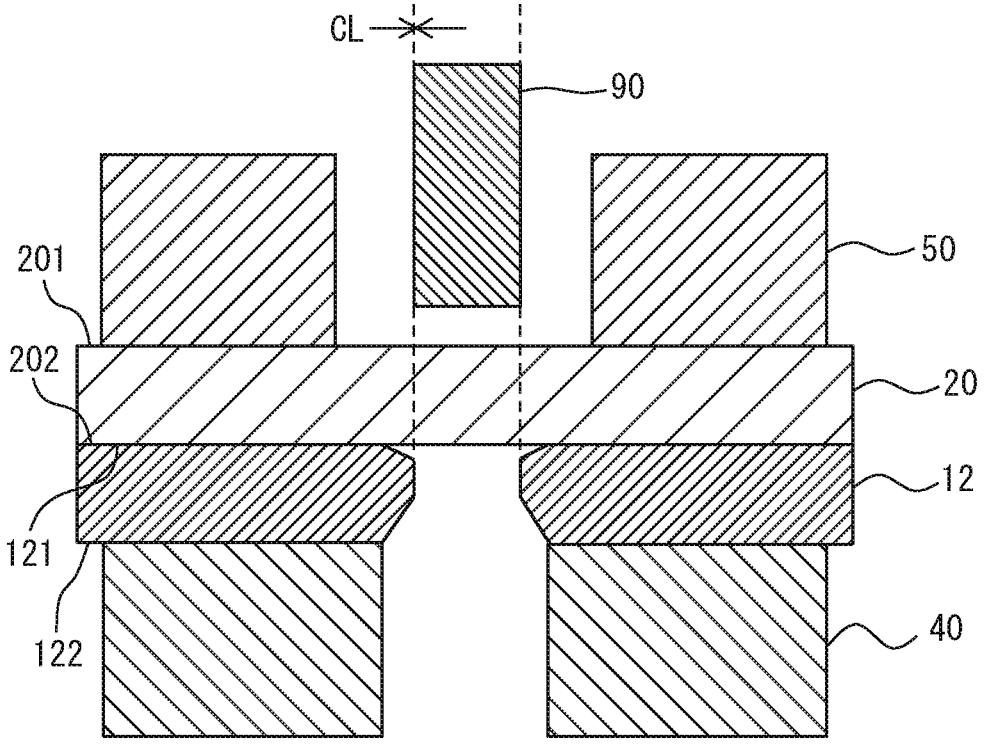
FIG. 11 is a cross-sectional schematic view showing an Embodiment 3 of the present method.
Figure 12:
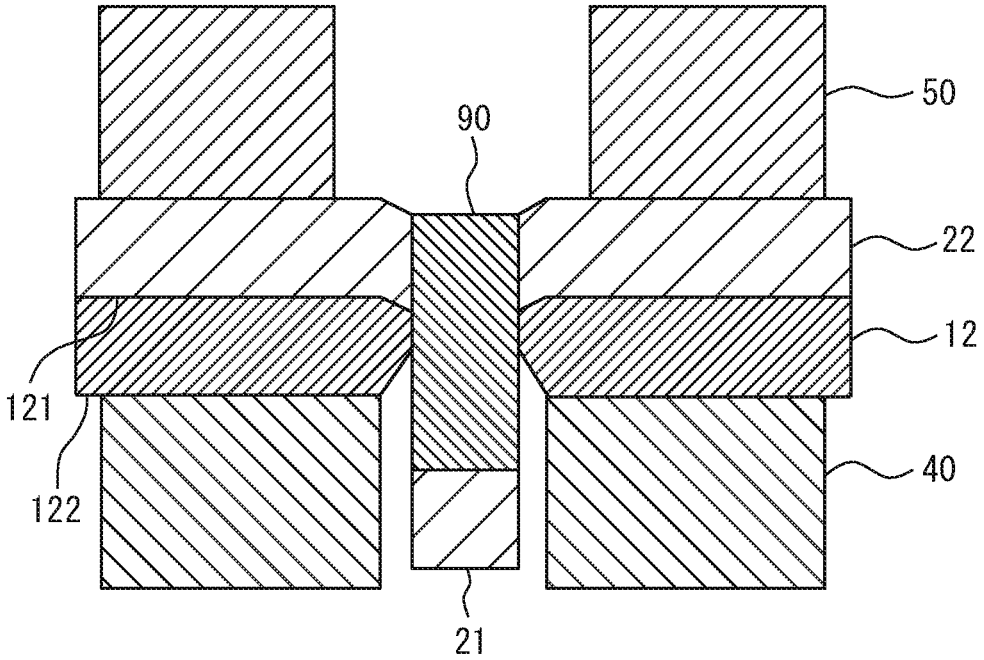
FIG. 12 is a cross-sectional schematic view showing an Embodiment 3 of the present method.

FIGS. 11 and 12 show another embodiment of the second shearing step in the shearing of the present method. The first worked material 12 punched at the first shearing step may also be used as the second die in the second shearing step in the punched state without changing its orientation. At the second shearing step shown in FIGS. 11 and 12, the first worked material 12 is used in the punched state as the second die. In more detail, the first worked material 12 is placed between the first die 40 and the second blank 20 for use as the second die so that the first surface 121 of the first worked material 12 faces the second blank 20 and so that the inside diameter of the first worked material 12 matches with the scheduled punching location at the second blank 20. From this state, the first punch 90 can punch the second blank 20 from the first surface 201 of the second blank 20 toward the second surface 202 to obtain the second punched out material 21 and the second worked material 22. Here, the first worked material having the first surface 121 at the second blank 20 side and having the second surface 122 at the first die 40 side, that is, "the first worked material in the punched state", will also be referred to as the "first worked material 12" or the "first noninverted worked material 12".

In the second shearing step shown in FIGS. 11 and 12, the second blank 20 placed on the first noninverted worked material 12 used as the second die is punched by the first punch 90 to obtain the second punched out material 21 and the second worked material 22. The first noninverted worked material 12 is work hardened when processed at the first shearing step. Further, it is supported by the first die 40. Therefore, even if the second blank 20 is the same material as the first blank 10, the first noninverted worked material 12 can be used the second die to shear the second blank 20.

As shown by the broken line in FIG. 11, in the second shearing step in the present embodiment, the inside diameter of the first worked material 12 used as the second die and the outside diameter of the first punch 90 are substantially the same. As shown by the broken line in FIG. 11, the "inside diameter of the first worked material 12" is the inside diameter of the burnished surface of the sheared edge of the first worked material 12 in the direction perpendicular to the punching direction (same below). If using the first worked material 12 as the second die for shearing, the clearance CL between the inside diameter of the first worked material 12 and the outside diameter of the first punch 90 becomes smaller than the clearance CL between the inside diameter of the first die 40 and the outside diameter of the first punch 90, preferably becomes about 0 mm. For this reason, the amount of the second blank 20 drawn into the clearance CL by the first punch 90 is decreased, and the second worked material 22 can be given a sheared edge excellent in surface perpendicularity and surface properties. The second punched out material 21 can also similarly be given a sheared edge excellent in surface perpendicularity and surface properties. Further, since the first worked material 12 is used as the second die, it is possible to manufacture a worked material (product) with a good productivity while suppressing wear and damage of the tool (in the present embodiment, the first die 40).

Embodiment 4

Figure 13:
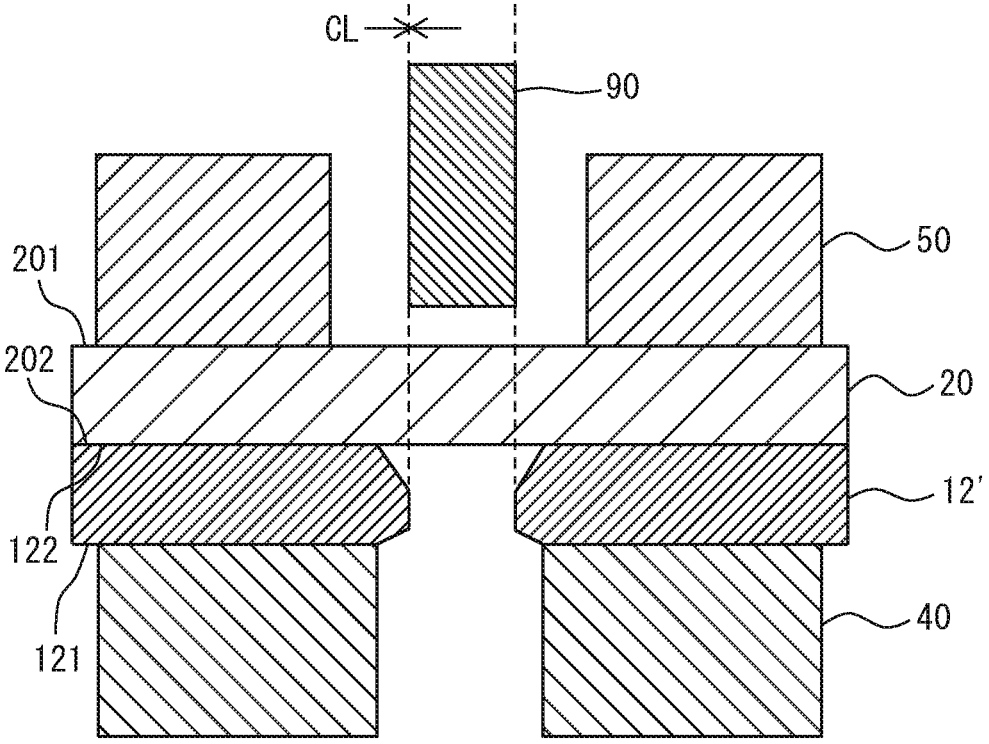
FIG. 13 is a cross-sectional schematic view showing an Embodiment 4 of the present method.
Figure 14:
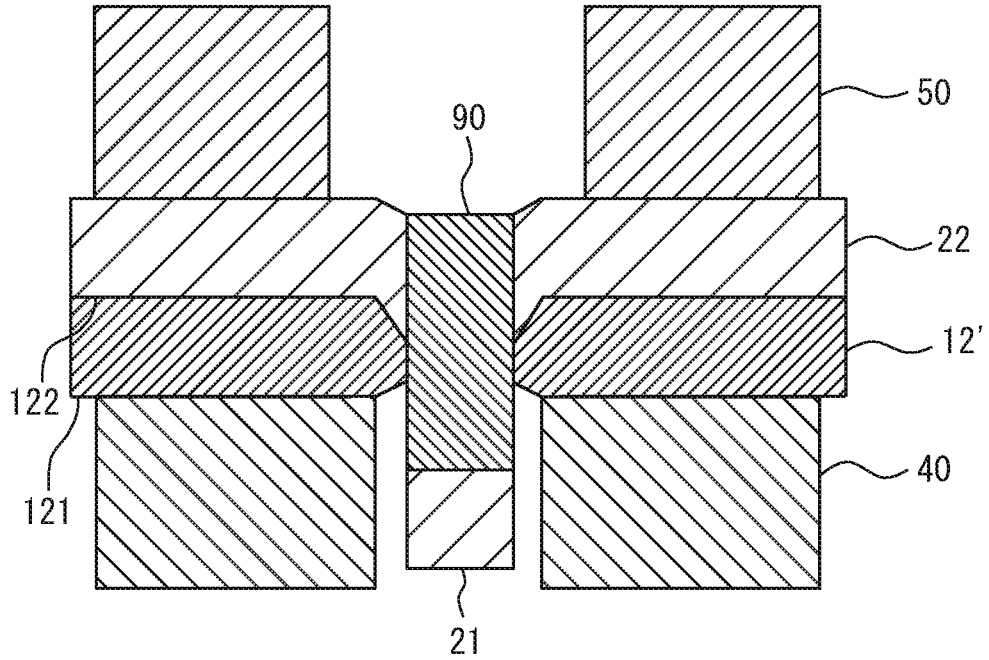
FIG. 14 is a cross-sectional schematic view showing an Embodiment 4 of the present method.

FIGS. 13 and 14 show another embodiment of the second shearing step at the shearing of the present method. The first worked material 12 processed at the first shearing step shown in FIG. 6 may be used as the second die in the second shearing step inverted from the punched state. Here, the first worked material having the first surface 121 at the first die 40 side and having the second surface 122 at the second blank 20 side, that is, "the first worked material inverted from the punched state", will also be called the "first worked material 12'" or the "first inverted worked material 12'". At the second shearing step shown in FIGS. 13 and 14, the first worked material processed at the first shearing step is used as the second die inverted from the punched state. In more detail, the first inverted worked material 12' is placed at the scheduled punching location between the first die 40 and the second worked material 20 so that the second surface 122 faces the second blank 20 and so that the inside diameter of the first worked material 12' matches with the scheduled punching location at the second blank 20. From this state, the first punch 90 can punch the second blank 20 from the first surface 201 of the second blank 20 toward the second surface 202 to thereby obtain the second punched out material 21 and the second worked material 22.

In the second shearing step shown in FIGS. 13 and 14, the second blank 20 placed on the first inverted worked material 12' used as the second die can be punched by the first punch 90 to obtain the second punched out material 21 and the second worked material 22. The first inverted worked material 12' is work hardened when it is processed by the first shearing step. Furthermore, it is supported by the first die 40, so even if the second blank 20 is the same material as the first blank 10, the first inverted worked material 12' can be used as the second die to shear the second blank 20.

As shown by the broken line in FIG. 13, the inside diameter of the first inverted worked material 12' used as the second die and the outside diameter of the first punch 90 are substantially the same. As shown by the broken line in FIG. 13, the "inside diameter of the first inverted worked material 12'" is the inside diameter of the burnished surface of the sheared edge of the first inverted worked material 12' in the direction perpendicular to the punching direction (same below). That is, in the present embodiment as well, in the same way as the Embodiment 3, the clearance CL between the inside diameter of the first worked material 12' and the outside diameter of the first punch 90 becomes smaller than the clearance CL between the inside diameter of the first die 40 and the outside diameter of the first punch 90, preferably becomes about 0 mm. For this reason, the amount of the second blank 20 drawn into the clearance CL by the first punch 90 is decreased. The second worked material 22 can be given a sheared edge excellent in surface perpendicularity and surface properties. The second punched out material 21 similarly can be given a sheared edge excellent in surface perpendicularity and surface properties. Further, since the first inverted worked material 12' is used as the second die, it is possible to manufacture a worked material (product) with a good productivity while suppressing wear and damage of the tool (in the present embodiment, the first die 40).

Embodiment 5

Figure 15:
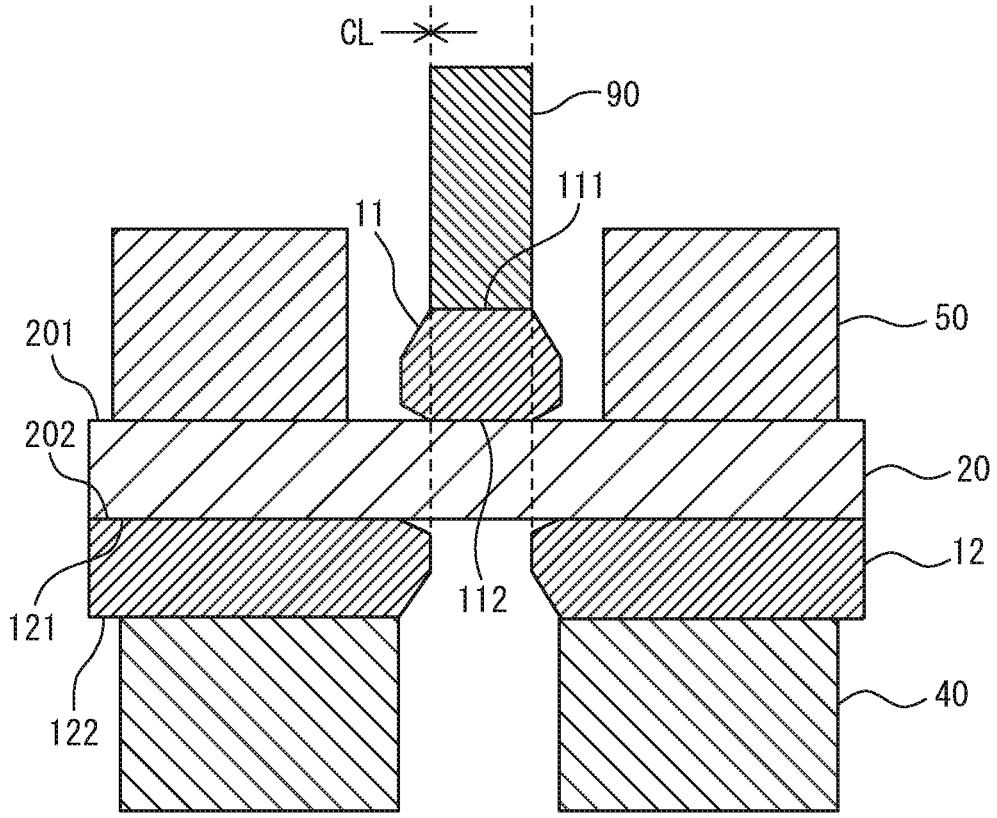
FIG. 15 is a cross-sectional schematic view showing an Embodiment 5 of the present method.
Figure 16:
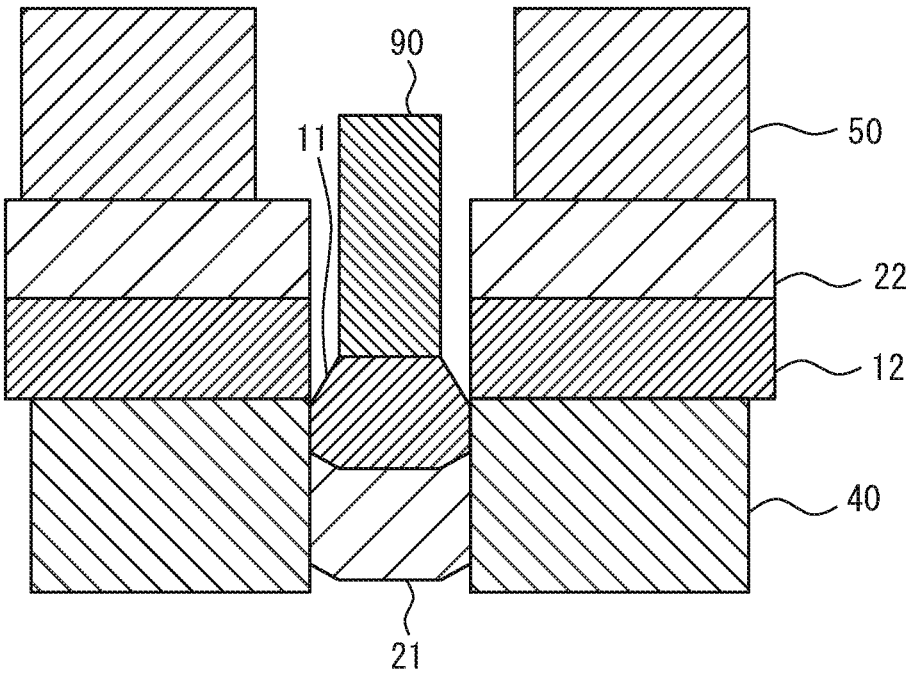
FIG. 16 is a cross-sectional schematic view showing an Embodiment 5 of the present method.

FIGS. 15 and 16 show another embodiment of the second shearing step at the shearing of the present method. It is also possible to use the first punched out material 11 punched out at the first shearing step shown in FIG. 6 as the second punch at the second shearing step in the punched out state without changing the orientation and use the first worked material 12 processed at the first shearing step shown in FIG. 6 as the second die at the second shearing step in the punched state without changing the orientation. At the second shearing step shown in FIGS. 15 and 16, the first punched out material 11 is placed between the first punch 90 and the second blank 20 so that the second surface 112 of the first noninverted punched out material 11 punched out at the first shearing step faces the scheduled punching location at the second blank 20 and so that the first surface 111 faces the first punch 90. In addition to this, at the second shearing step shown in FIGS. 15 and 16, the first worked material 12 is placed between the first die 40 and the second blank 20 so that the first surface 121 of the first noninverted worked material 12 processed at the first shearing step faces the second blank 20 and so that the inside diameter of the first worked material 12 matches with the scheduled punching location at the second blank 20. From this state, the first punch 90 can push down the first noninverted punched out material 11 used as the second punch to shear the second blank 20 from the first surface 201 of the second blank 20 toward the second surface 202 to obtain the second punched out material 21 and the second worked material 22. Note that, the first punched out material 11 and the first worked material 12 have equivalent hardnesses, but the first punched out material 11 is pushed in by the punch 90, so the first worked material 12 can also be sheared by the first punched out material 11.

As shown by the broken line in FIG. 15, the outside diameter of the first punched out material 11 used as the second punch is larger than the inside diameter of the first worked material 12 used as the second die. It is possible to reduce the clearance CL, preferably possible to make it about 0 mm. For this reason, the amount of the second blank 20 drawn into the clearance CL by the first noninverted punched out material 11 is decreased. The second worked material 22 can be given a sheared edge excellent in surface perpendicularity and surface properties. The second punched out material 21 can similarly be given a sheared edge excellent in surface perpendicularity and surface properties. Further, the first noninverted punched out material 11 is used as the second punch while the first noninverted worked material 12 is used as the second die, so it is possible to manufacture a worked material (product) with a good productivity while suppressing wear and damage of the tool (in the present embodiment, the first punch 90 and the first die 40).

Embodiment 6

Figure 17:
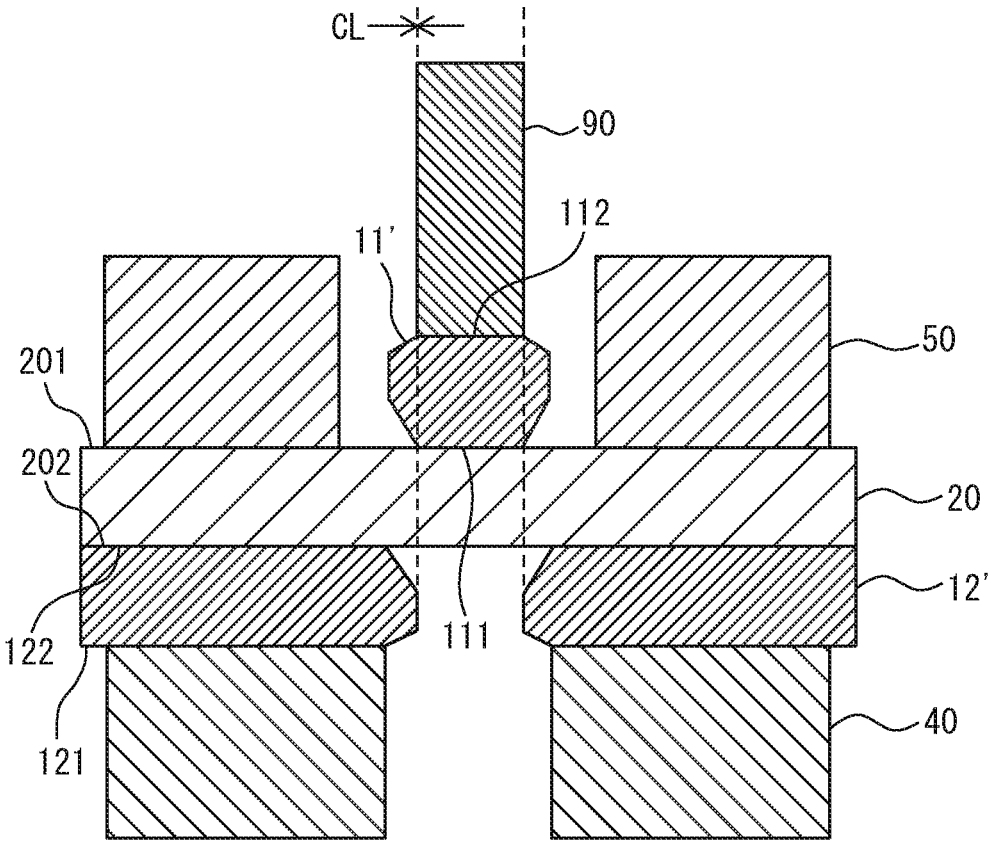
FIG. 17 is a cross-sectional schematic view showing an Embodiment 6 of the present method.
Figure 18:
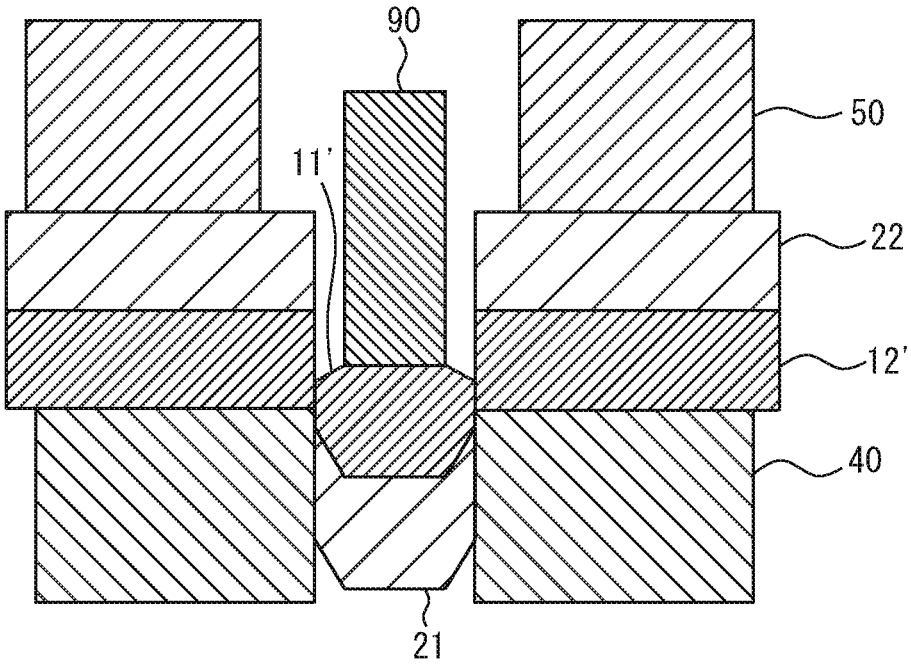
FIG. 18 is a cross-sectional schematic view showing an Embodiment 6 of the present method.

FIGS. 17 and 18 show another embodiment of the second shearing step at the shearing of the present method. It is also possible to use the first punched out material 11 punched out at the first shearing step shown in FIG. 6 as the second punch at the second shearing step inverted from the punched out state and use the first worked material 12 processed at the first shearing step shown in FIG. 6 as the second die at the second shearing step inverted from the punched state. At the second shearing step shown in FIGS. 17 and 18, the first inverted punched out material 11' is placed between the first punch 90 and the second blank 20 so that the first surface 111 of the first inverted punched out material 11' punched out at the first shearing step faces the scheduled punching location at the second blank 20 and so that the second surface 112 faces the first punch 90. In addition to this, in the second shearing step shown in FIGS. 17 and 18, the first inverted worked material 12' is placed at the scheduled punching location between the first die 40 and the second worked material 20 so that the second surface 122 of the first inverted worked material 12' processed at the first shearing step faces the second blank 20 and so that the inside diameter of the first inverted worked material 12' matches with the scheduled punching location at the second blank 20. From this state, the first punch 90 can push down the first inverted punched out material 11' used as the second punch to shear the second blank 20 from the first surface 201 of the second blank 20 toward the second surface 202 to obtain the second punched out material 21 and the second worked material 22. Note that, the first punched out material 11' and the first worked material 12' have equivalent hardnesses, but the first punched out material 11' is pushed in by the punch 90, so the first worked material 12' can also be sheared by the first punched out material 11'.

As shown by the broken line in FIG. 17, the outside diameter of the first inverted punched out material 11' used as the second punch is larger than the inside diameter of the first inverted worked material 12' used as the second die. It is possible to reduce the clearance CL, preferably possible to make it about 0 mm. For this reason, the amount of the second blank 20 drawn into the clearance CL by the first inverted punched out material 11' is decreased. The second worked material 22 can be given a sheared edge excellent in surface perpendicularity and surface properties. The second punched out material 21 can similarly be given a sheared edge excellent in surface perpendicularity and surface properties. Further, the first inverted punched out material 11' is used as the second punch while the first inverted worked material 12' is used as the second die, so it is possible to manufacture a worked material (product) with a good productivity while suppressing wear and damage of the tool (in the present embodiment, the first punch 90 and the first die 40).

Embodiment 7

Figure 19:
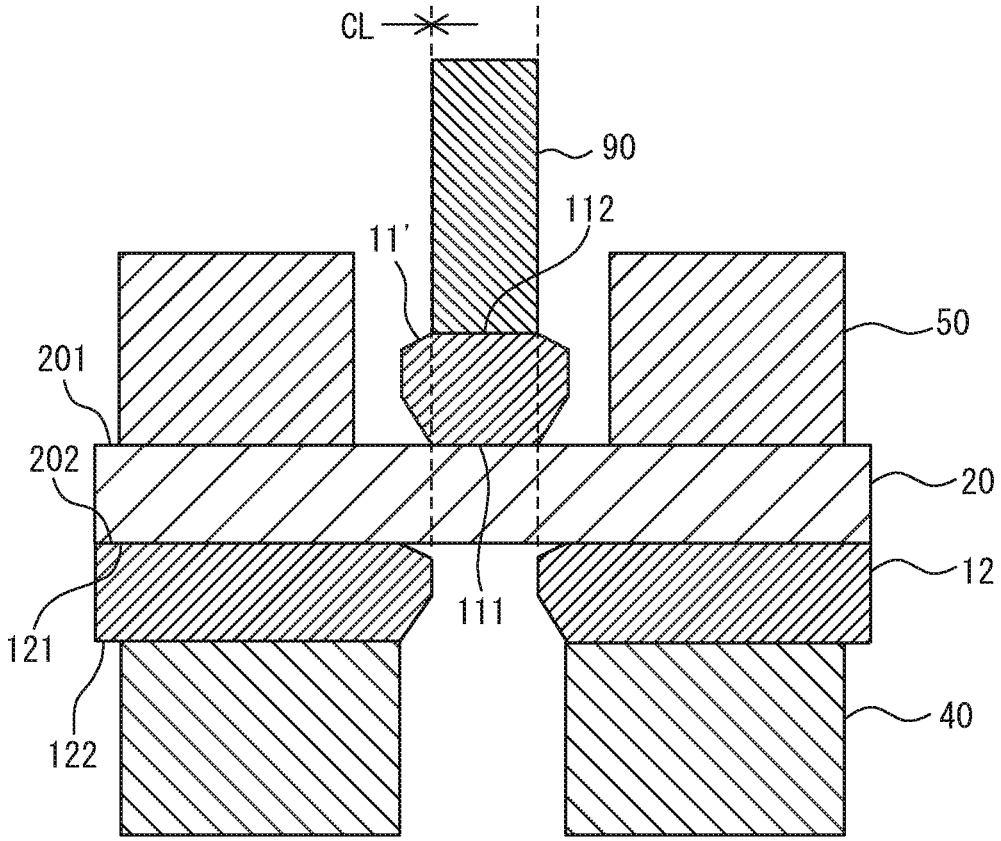
FIG. 19 is a cross-sectional schematic view showing an Embodiment 7 of the present method.
Figure 20:
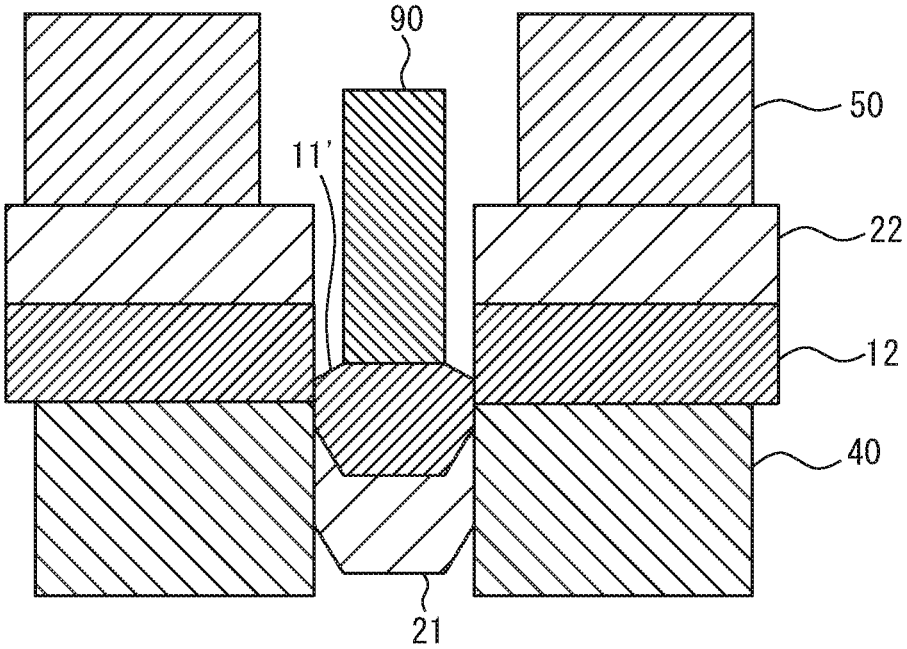
FIG. 20 is a cross-sectional schematic view showing an Embodiment 7 of the present method.

FIGS. 19 and 20 show another embodiment of the second shearing step at the shearing of the present method. The first punched out material 11 punched out in the first shearing step shown in FIG. 6 may be used as the second punch in the second shearing step inverted from the punched out state while the first worked material 12 processed at the first shearing step shown in FIG. 6 may be used as the second die in the second shearing step in the punched state. In the second shearing step shown in FIGS. 19 and 20, the first inverted punched out material 11' is placed at the scheduled punching location between the first punch 90 and the second blank 20 so that the first surface 111 of the first inverted punched out material 11' punched out at the first shearing step faces the scheduled punching location at the second blank 20 and so that the second surface 112 faces the first punch 90. In addition to this, at the second shearing step shown in FIGS. 19 and 20, the first inverted worked material 12 is placed at the scheduled punching location between the first die 40 and the second worked material 20 so that the first surface 121 of the first noninverted worked material 12 processed at the first shearing step faces the second blank 20 and so that the inside diameter of the first noninverted worked material 12 matches with the scheduled punching location at the second blank 20. From this state, it is possible to shear the second blank 20 from the first surface 201 of the second blank 20 toward the second surface 202 to obtain the second punched out material 21 and the second worked material 22. Note that, the first punched out material 11' and the first worked material 12 have equivalent hardnesses, but the first punched out material 11' is pushed in by the punch 90, so the first worked material 12 can also be sheared by the first punched out material 11'.

As shown by the broken line in FIG. 19, the outside diameter of the first inverted punched out material 11' used as the second punch is larger than the inside diameter of the first noninverted worked material 12 used as the second die. It is possible to reduce the clearance CL, preferably possible to make it about 0 mm. For this reason, the amount of the second blank 20 drawn into the clearance CL by the first inverted punched out material 11' is decreased and the second worked material 22 can be given a sheared edge excellent in surface perpendicularity and surface properties. The second punched out material 21 can also similarly be given a sheared edge excellent in surface perpendicularity and surface properties. Further, since the first inverted punched out material 11' is used as the second punch while the first noninverted worked material 12 is used as the second die, it is possible to manufacture a worked material (product) with a good productivity while suppressing wear and damage of the tool (in the present embodiment, the first punch 90 and the first die 40).

Embodiment 8

Figure 21:
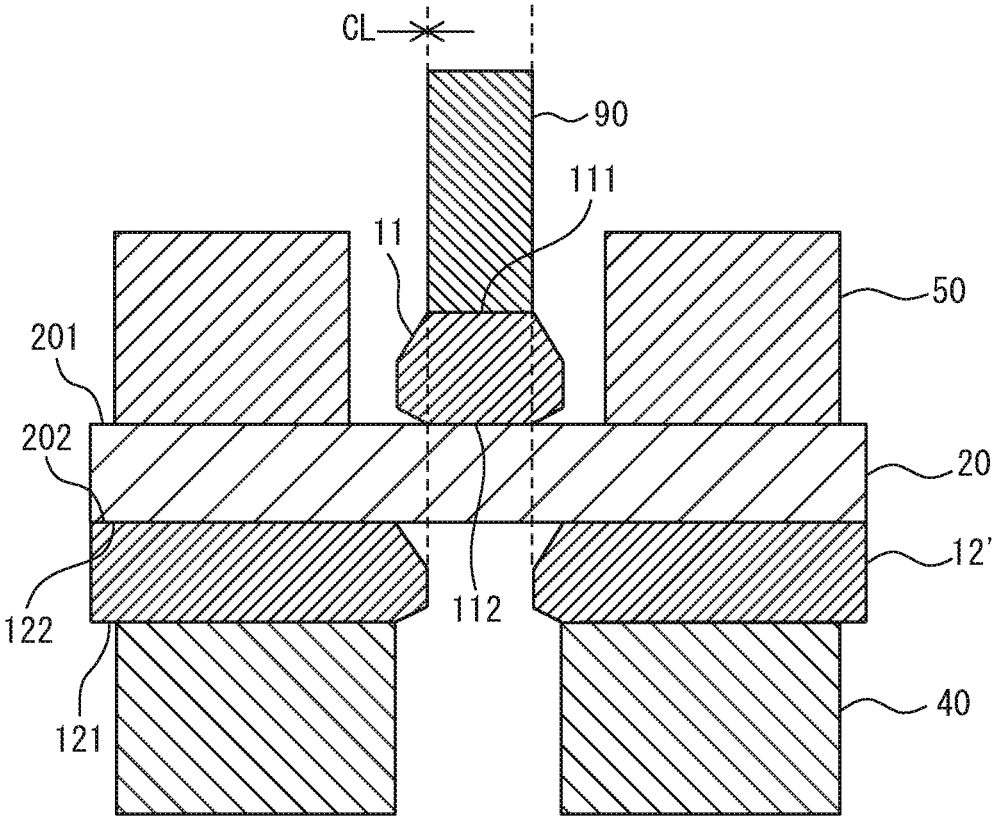
FIG. 21 is a cross-sectional schematic view showing an Embodiment 8 of the present method.
Figure 22:
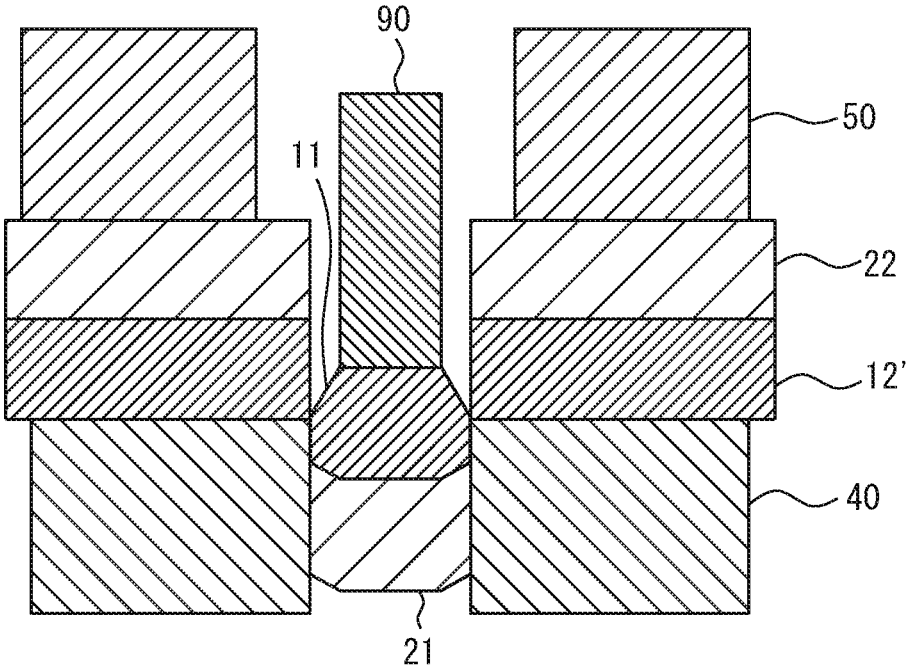
FIG. 22 is a cross-sectional schematic view showing an Embodiment 8 of the present method.

FIGS. 21 and 22 show another embodiment of the second shearing step in the shearing of the present method. The first punched out material 11 punched out at the first shearing step shown in FIG. 6 may be used as the second punch in the punched out state while the first worked material processed at the first shearing step shown in FIG. 6 may be used as the second die inverted from the punched state. At the second shearing step shown in FIGS. 21 and 22, the first noninverted punched out material 11 is placed at a scheduled punching location between the first punch 90 and the second blank 20 so that the second surface 112 of the first noninverted punched out material 11 punched out at the first shearing step faces the scheduled punching location at second blank 20 and so that the first surface 111 faces the first punch 90. In addition to this, at the second shearing step shown in FIGS. 21 and 22, the first inverted worked material 12' is placed at a scheduled punching location between the first die 40 and the second worked material 20 so that the second surface 122 of the first inverted worked material 12' processed at the first shearing step faces the second blank 20 and so that the inside diameter of the first inverted worked material 12' matches with the scheduled punching location at the second blank 20. From this state, the first punch 90 can push down the first noninverted punched out material 11 used as the second punch and shear the second blank 20 from the first surface 201 of the second blank 20 toward the second surface 202 to obtain the second punched out material 21 and the second worked material 22. Note that, the first punched out material 11 and the first worked material 12' have equivalent hardnesses, but the first punched out material 11 is pushed in by the punch 90, so the first worked material 12' can also be sheared by the first punched out material 11.

As shown by the broken line in FIG. 21, the outside diameter of the first noninverted punched out material 11 used as the second punch is larger than the inside diameter of the first inverted worked material 12' used as the second die. It is possible to reduce the clearance CL, preferably possible to make it about 0 mm. For this reason, the amount of the second blank 20 drawn into the clearance CL by the first noninverted punched out material 11 is decreased and the second worked material 22 can be given a sheared edge excellent in surface perpendicularity and surface properties. The second punched out material 21 may similarly be given a sheared edge excellent in surface perpendicularity and surface properties. Further, since the first noninverted punched out material 11 is used as the second punch and the first inverted worked material 12' is used as the second die, it is possible to manufacture a worked material (product) with a good productivity while suppressing wear and damage of the tool (in the present embodiment, the first punch 90 and the first die 40).

The present method includes any one of the Embodiments 1 to 8. The Embodiments 1, 3, 5, and 6 to 8 are preferable, while the Embodiments 1 and 6 to 8 are more preferable. In the Embodiments 1 to 8, the average residual stress at the sheared edge can be made smaller than the past, while in the Embodiments 1, 3, 5, and 6 to 8, it may be made even smaller. In particular, in the Embodiments 1 and 6 to 8, it is possible to make the average residual stress at the sheared edge the compression side.

Embodiment 9

The present method preferably comprises a third shearing step of shearing a third blank to obtain a third punched out material and a third worked material by (x) using the second punched out material as a third punch, (y) using the second worked material as a third die, or (z) using the second punched out material as a third punch and using the second worked material as a third die.

The second punched out material and the second worked material, in the same way as the first punched out material and the first worked material, can be used as the third punch and the third die in the noninverted or inverted state. The second punched out material used as the third punch and the first worked material used as the second die or the first die may be combined for use, while the second worked material used as a third die and the first punched out material used as the second punch or the first punch may be combined for use. The combination is not particularly limited so long as a combination where the clearance between the first punch or the punched out material used as the second or later punches and the first die or the worked material used as the second or later dies becomes smaller compared with the conventional shearing shown in FIG. 5.

The sheared edges of the second punched out material and the second worked material are excellent in surface perpendicularity and surface properties as explained above. Therefore, the third worked material can be given a sheared edge more excellent in surface perpendicularity and surface properties. The third punched out material similarly can also be given a sheared edge more excellent in surface perpendicularity and surface properties. Further, since the second punched out material is used as the third punch and/or the second worked material is used as the third die, it is possible to manufacture a worked material (product) with a good productivity while suppressing wear and damage of the tool (the first punch and/or the first die).

Figure 23:
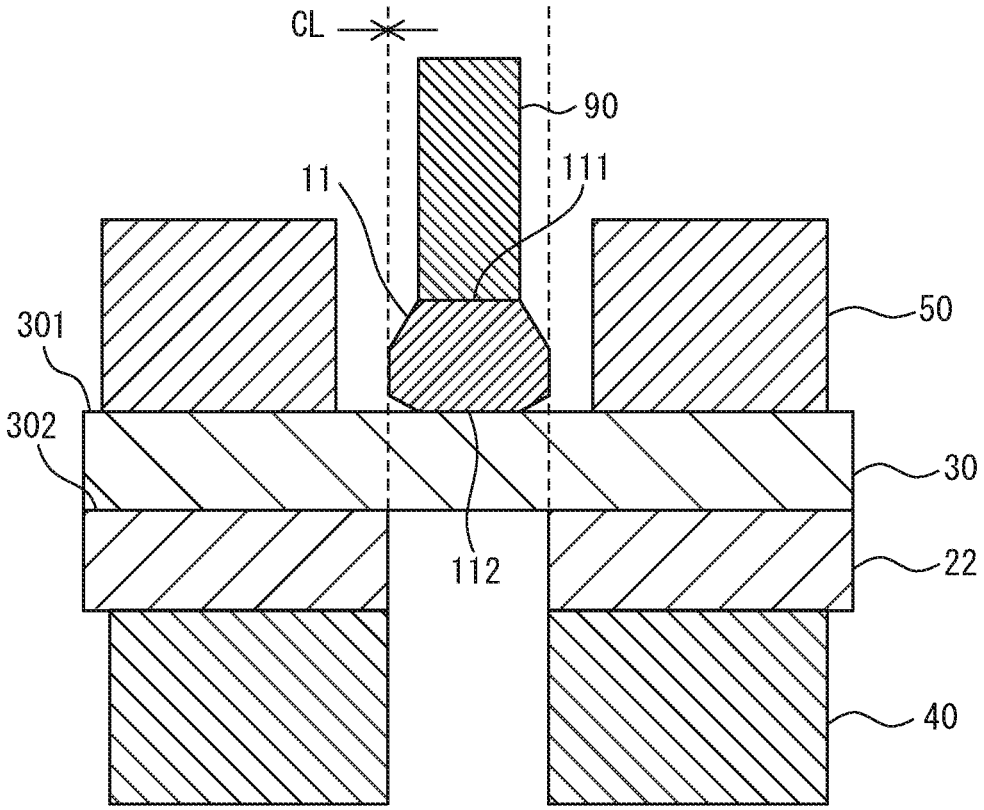
FIG. 23 is a cross-sectional schematic view showing an Embodiment 9 of the present method.
Figure 24:
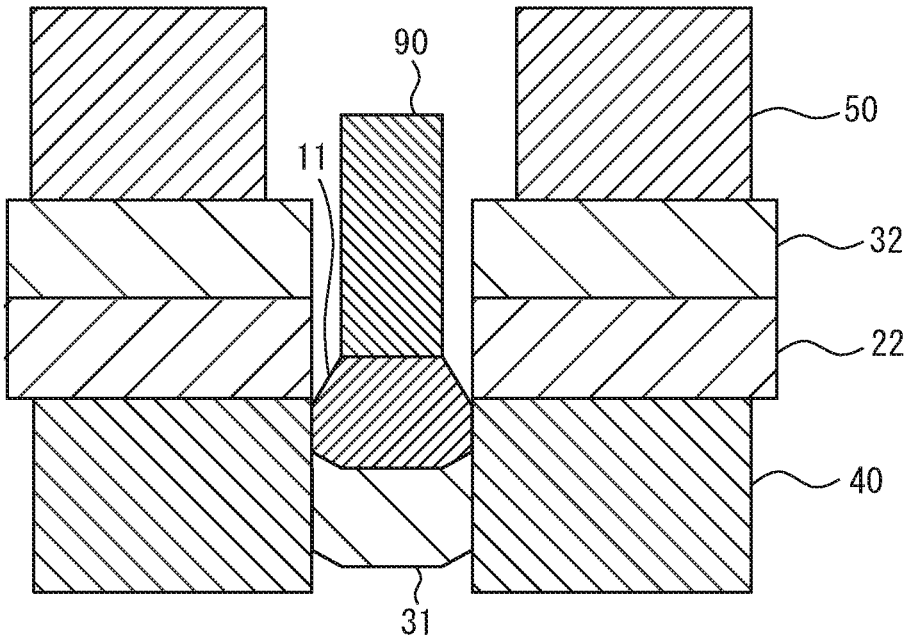
FIG. 24 is a cross-sectional schematic view showing an Embodiment 9 of the present method.
Figure 25:
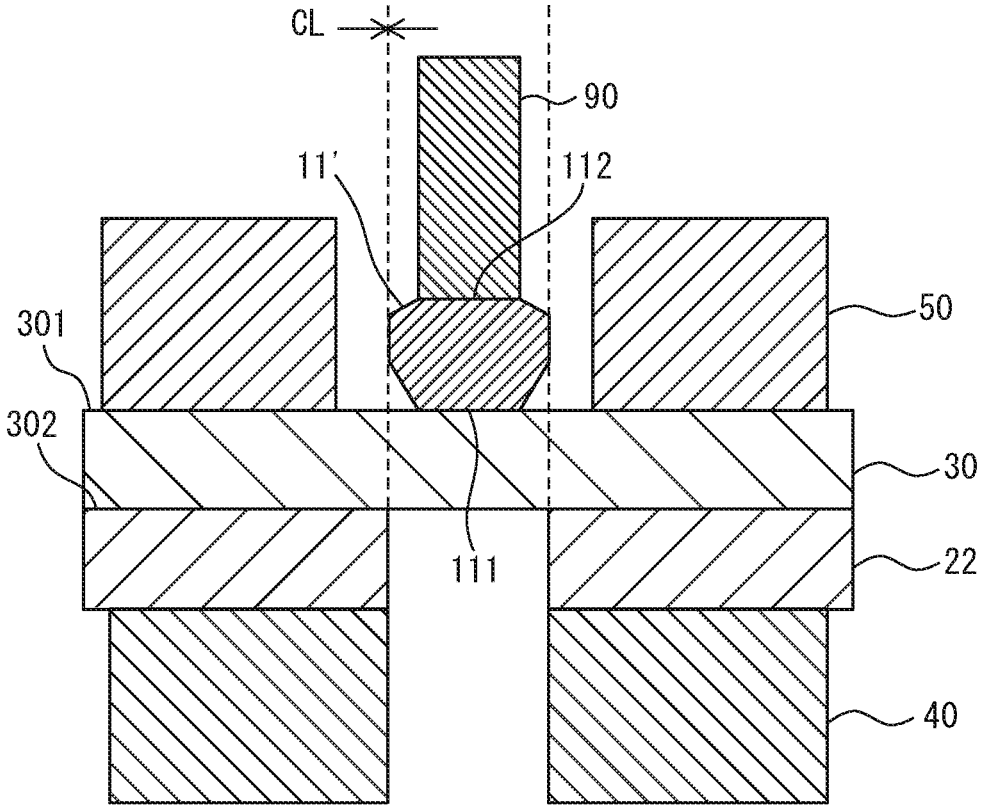
FIG. 25 is a cross-sectional schematic view showing an Embodiment 9 of the present method.
Figure 26:
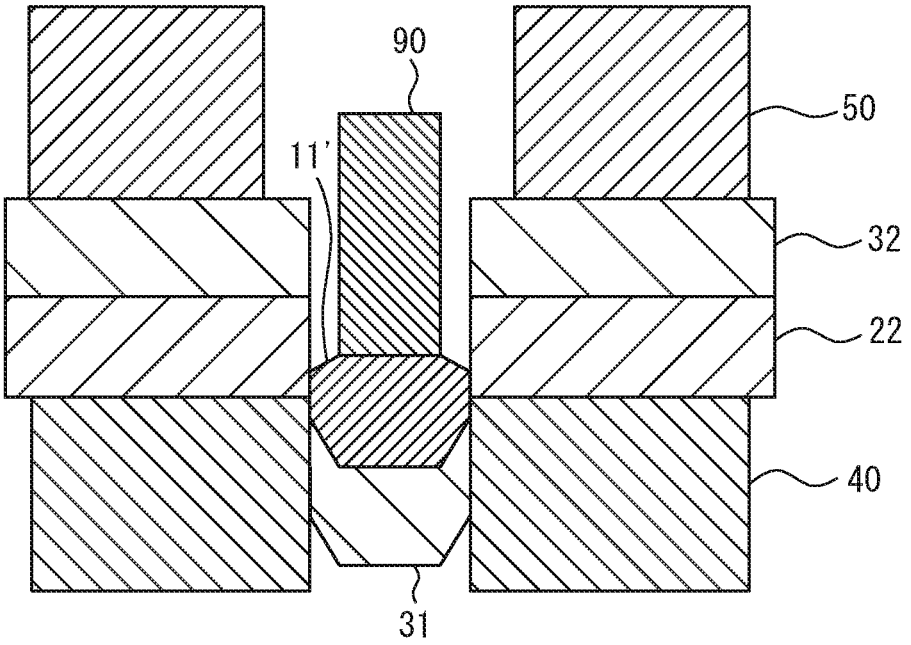
FIG. 26 is a cross-sectional schematic view showing an Embodiment 9 of the present method.

FIGS. 23 to 26 illustrate two embodiments of the third shearing with respect to the third blank, but the invention is not limited to these combinations. FIGS. 23 and 24 show an embodiment placing the second worked material 22 obtained in the Embodiment 1 shown in FIGS. 7 and 8 between the first die 40 and the third blank 30 and using it as the third die. In FIGS. 23 and 24, the first punched out material 11 used in the Embodiment 1 shown in FIGS. 7 and 8 is again used as the second punch to shear the third blank 30 and obtain the third punched out material 31 and worked material 32. FIGS. 25 and 26 show an embodiment arranging the second worked material 22 obtained in the Embodiment 1 shown in FIGS. 7 and 8 between the first die 40 and the third blank 30 and using it as the third die. In FIGS. 25 and 26, the first punched out material used in the Embodiment 1 shown in FIGS. 7 and 8 is inverted to obtain the first inverted punched out material 11' for use again as the second punch to shear the third blank 30 and obtain the third punched out material 31 and the third worked material 32.

In the third shearing step illustrated in FIGS. 23 to 26 as well, as shown by the broken lines in FIGS. 23 and 25, it is possible to make the clearance CL between the outside diameter of any of the first punched out material 11 or the first inverted punched out material 11' used again as the second punch and the inside diameter of the first die 40 smaller than the clearance CL between the outer shape of the first punch 90 and the inside diameter of the first die 40, preferably make it about 0 mm. Therefore, in the same way as the Embodiments 1 to 8, the third worked material 32 can be formed with a sheared edge having excellent surface perpendicularity, having excellent surface properties with suppressed residual tensile stress, and excellent in hydrogen embrittlement resistance and fatigue characteristics.

In the third shearing step illustrated in FIGS. 23 to 26, the first punched out material used again as the second punch and the second worked material used as the third die have sheared edges excellent in surface perpendicularity and surface properties as explained above. For this reason, the third worked material 32 can be given a sheared edge more excellent in surface perpendicularity and surface properties. The third punched out material 31 as well can similarly be given a sheared edge better in surface perpendicularity and surface properties. Further, if using the first punched out material as the second punch and using the second worked material as the third die, it is possible to manufacture worked materials (products) with a good productivity while suppressing wear and damage of the tools (first die 40 and first punch 90).

In the same way as the Embodiment 9, it is possible to shear a fourth and later blanks. That is, it is possible to use the punched out material as a punch or use the worked material as a die for repeated reuse. If a punched out material and worked material are used a larger number of times, the end face properties deteriorate, so the upper limit of the number of times of repeated use can be made within 100 times or within 10 times.

Embodiment 10

Figure 27:
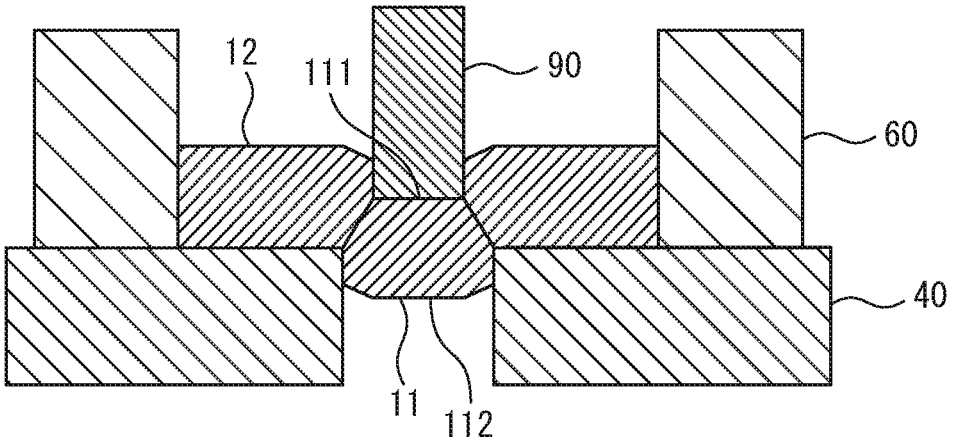
FIG. 27 is a cross-sectional schematic view showing an Embodiment 10 of the present method.
Figure 28:
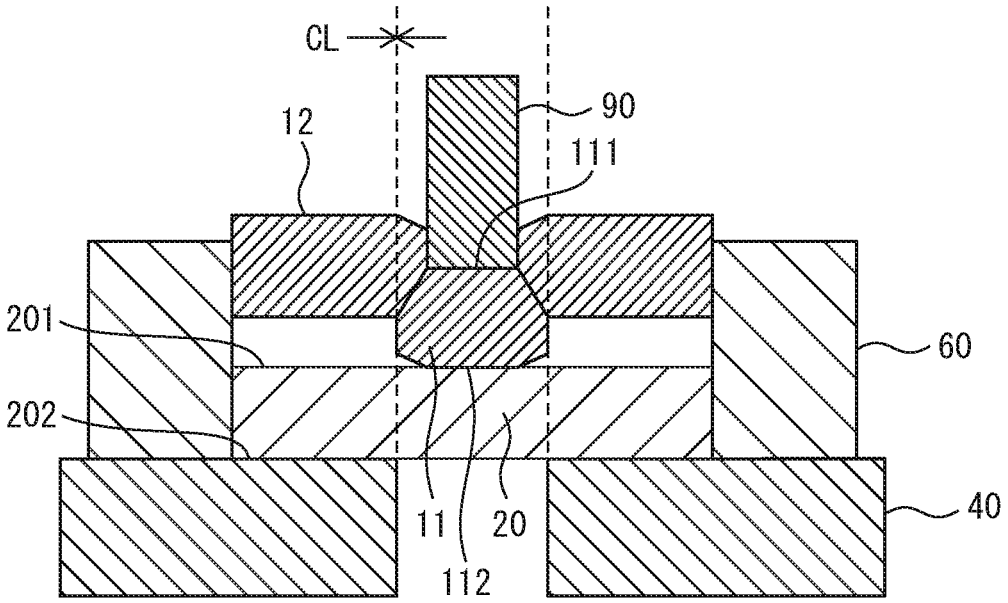
FIG. 28 is a cross-sectional schematic view showing an Embodiment 10 of the present method.

FIGS. 27 and 28 show another embodiment of shearing of the present method. As a positioning jig of the punched out material used as the second punch, the worked material can be used. FIG. 27 shows an embodiment placing a fastening jig 60 at an outer circumference of the first blank to fasten the first blank in the first shearing step shown in FIGS. 5 and 6 while shearing the first blank to obtain the first punched out material 11 and the first worked material 12.

FIG. 28 shows the second shearing step after FIG. 27. FIG. 28 shows an embodiment fastening an outer circumference of the second blank 20 and an outer circumference of the first worked material 12 obtained in the first shearing step by the fastening jig 60 arranged at the same position as the first shearing step while using the first punched out material 11 obtained at the first shearing step as the second punch to shear the second blank 20.

The fastening jig 60 can fasten the outer circumference of the first worked material 12 at the same position as the first shearing step. For this reason, the relative position of the first worked material 12 with respect to the inside diameter of the first die 40 in the direction perpendicular to the punching direction becomes the same at the time of the first shearing and the time of the second shearing. The first punched out material 11 can be arranged so as to fit into the punched hole of the first worked material 12. For this reason, it is possible to arrange the first punched out material 11 at the center position of the punched hole of the first worked material 12 in the direction perpendicular to the punching direction. Therefore, it is possible to accurately position the first punched out material 11 with respect to the inside diameter of the first die 40 in the direction perpendicular to the punching direction and possible to suppress deviation of the first punched out material 11 in the direction perpendicular to the punching direction while shearing the second blank 20 by the second shearing. The first worked material 12 can also act as a holder for restraining the second blank 20 at the time of shearing.

The first punched out material can be used as a noninverted punched out material 11 or inverted punched out material 11'. If using the noninverted worked material 12 as a positioning member of the punched out material, the first punched out material is preferably used as a noninverted punched out material 11. The fit between the fracture surface of the punched out material and the fracture surface of the worked material is high, so positioning the punched out material used as the second punch and suppressing deviation of the punched out material in the direction perpendicular to the punching direction become easier. Further, after the first shearing, it is preferable to not separate the first punched out material 11, first worked material 12, and fastening jig 60 but to use them to shear the second blank while maintaining the assembled state after shearing. If using the inverted worked material 12' as the positioning member of the punched out material, the punched out material is preferably used as an inverted punched out material 11'. The fit between the shear droop of the punched out material and the shear droop of the worked material is high, so positioning the punched out material used as the second punch and suppressing deviation of the punched out material in the direction perpendicular to the punching direction become easier.

Embodiment 11

Figure 29:
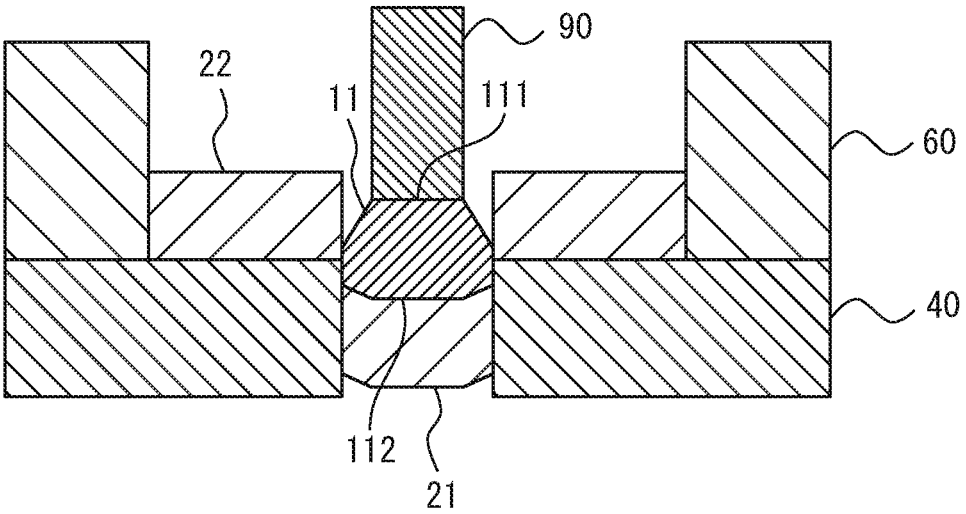
FIG. 29 is a cross-sectional schematic view showing an Embodiment 11 of the present method.
Figure 30:
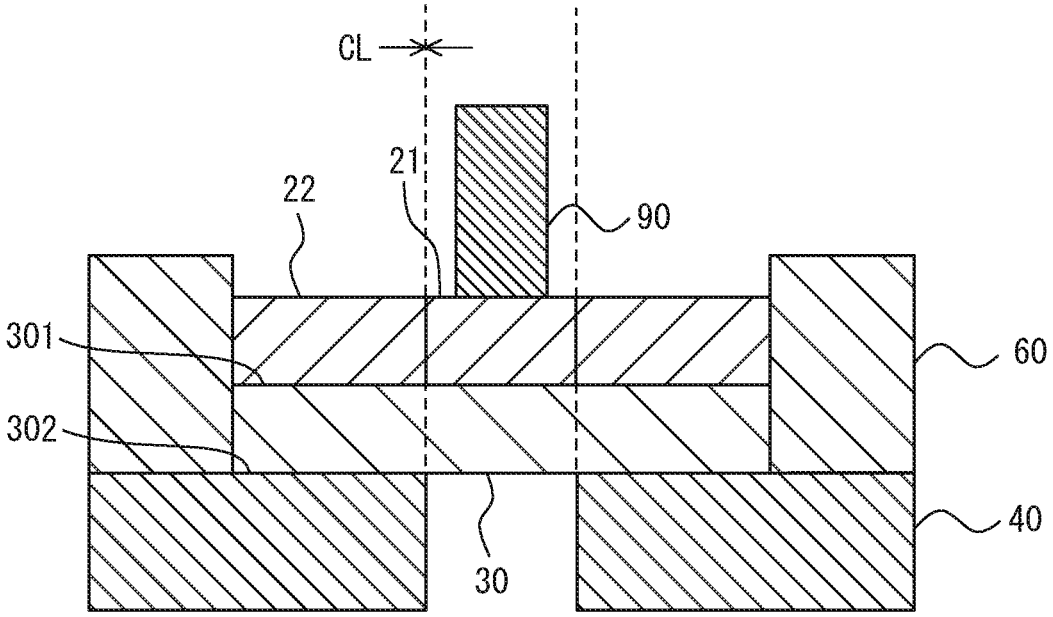
FIG. 30 is a cross-sectional schematic view showing an Embodiment 11 of the present method.

FIGS. 29 and 30 show another embodiment of the shearing of the present method. As the positioning jig of the punched out material used as the second punch, it is possible to use the worked material. FIG. 29 shows an embodiment in which in the second shearing step shown in FIGS. 7 and 8, the fastening jig 60 is arranged at the outer circumference of the second blank to fasten the second blank while shearing the second blank to obtain the second punched out material 21 and the second worked material 22.

FIG. 30 shows an embodiment using the second punched out material 21 obtained in the second shearing step as the third punch to shear the third blank 30 in the third shearing step while fastening the outer circumference of the third blank 30 and the outer circumference of the second worked material 22 obtained in the second shearing step shown in FIG. 29 by the fastening jig 60 arranged at the same position as the second shearing step.

The fastening jig 60 can fasten the outer circumference of the second worked material 22 at the same position as the second shearing step. For this reason, the relative position of the second worked material 22 with respect to the inside diameter of the first die 40 in the direction perpendicular to the punching direction becomes the same at the time of the second shearing and the time of the third shearing. For this reason, it is possible to arrange the second punched out material 21 at the center position of the punched hole of the second worked material 22 in the direction perpendicular to the punching direction. Therefore, it is possible to accurately position the second punched out material 21 with respect to the inside diameter of the first die 40 in the direction perpendicular to the punching direction and possible to perform the third shearing of the third blank 30 while suppressing deviation of the second punched out material 21 in the direction perpendicular to the punching direction. The second worked material 22 can also act as a holder for holding down the third blank 30 at the time of shearing.

The second punched out material may be used as a noninverted punched out material 21 or inverted punched out material 21'. Instead of the second punched out material, the first punched out material may also be used. In each combination, it is possible to accurately position the punched out material with respect to the inside diameter of the first die 40 in the direction perpendicular to the punching direction and possible to perform shearing while suppressing deviation of the punched out material in the direction perpendicular to the punching direction.

In the shearing of the Embodiments 10 and 11 shown in FIGS. 27 to 30, the clearance CL between the inside diameter of the first die 40 and the outside diameter of the first punched out material 11 used as the second punch or the outside diameter of the second punched out material 21 used as the third punch can be made smaller, preferably can be made about 0 mm. Therefore, it is possible to form at the worked material (product) a sheared edge having excellent surface perpendicularity, having excellent surface properties with suppressed residual tensile stress, and excellent in hydrogen embrittlement resistance or fatigue characteristics.

Embodiment 12

A first punch provided with projecting parts at the punching surface can be used to shear the first blank (first shearing) while making the projecting parts bite into the first surface of the first blank to obtain a punched out material and worked material. Next, the punched out material fastened to the punching surface of the first punch by engagement of the projecting parts can be used as a second punch to shear the second blank (second shearing). FIGS. 31 to 34 show another embodiment of shearing of the present method.

Figure 31:
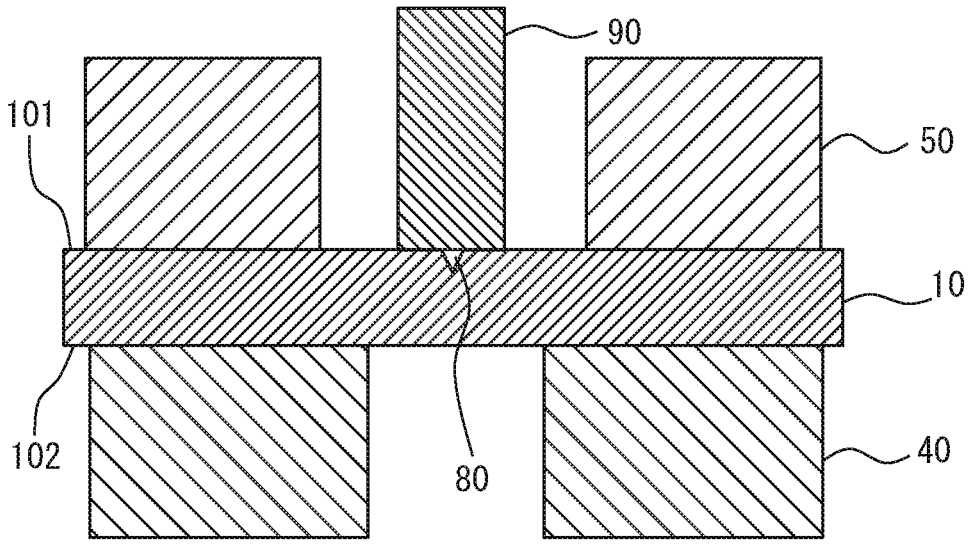
FIG. 31 is a cross-sectional schematic view showing an Embodiment 12 of the present method.
Figure 32:
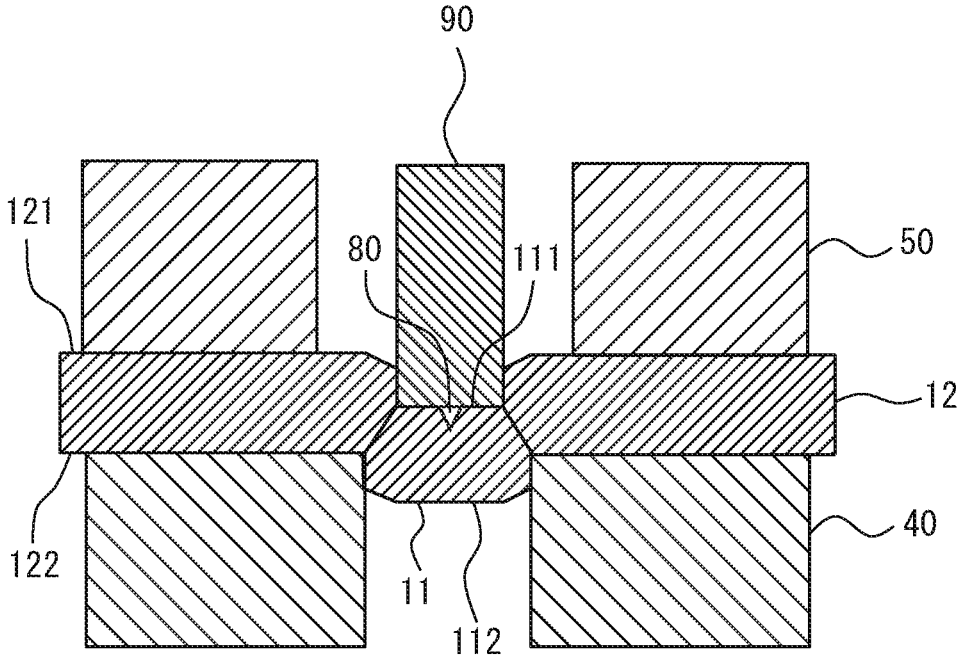
FIG. 32 is a cross-sectional schematic view showing an Embodiment 12 of the present method.

In FIGS. 31 and 32, the first punch 90 provided with the projecting parts 80 at the punching surface is used to shear the first blank 10 (first shearing) while making the projecting parts 80 bite into the first surface 101 of the first blank 10 to obtain the first punched out material 11 and the first worked material 12. By the projecting parts 80 biting into the first surface 111 of the first punched out material 11, the first punched out material 11 is fastened to the punching surface of the first punch 90.

Figure 33:
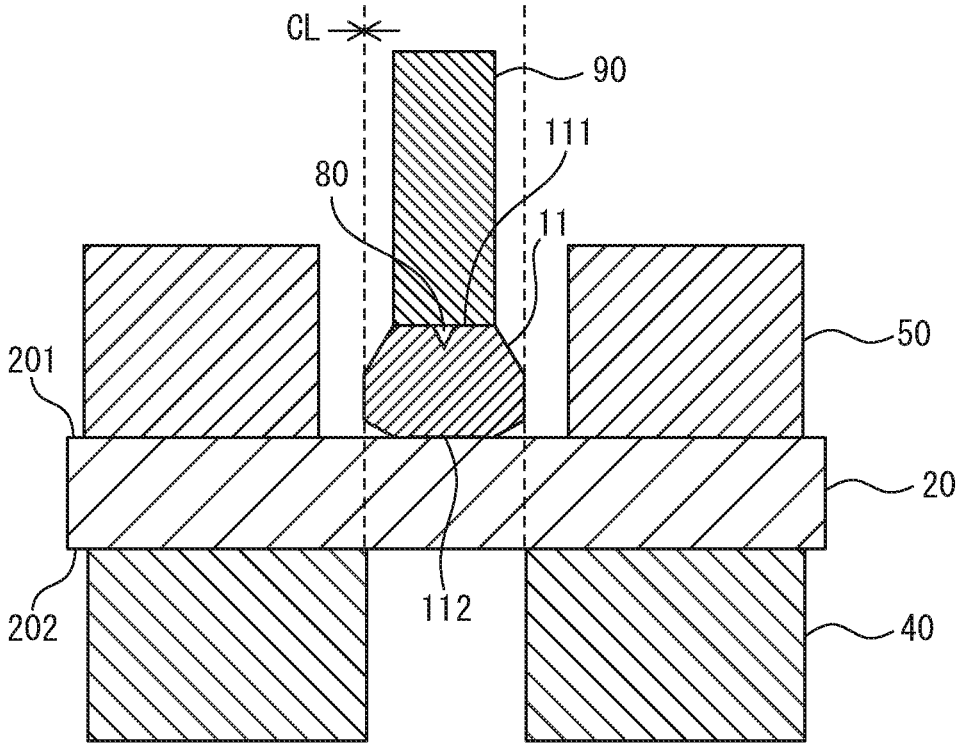
FIG. 33 is a cross-sectional schematic view showing an Embodiment 12 of the present method.
Figure 34:
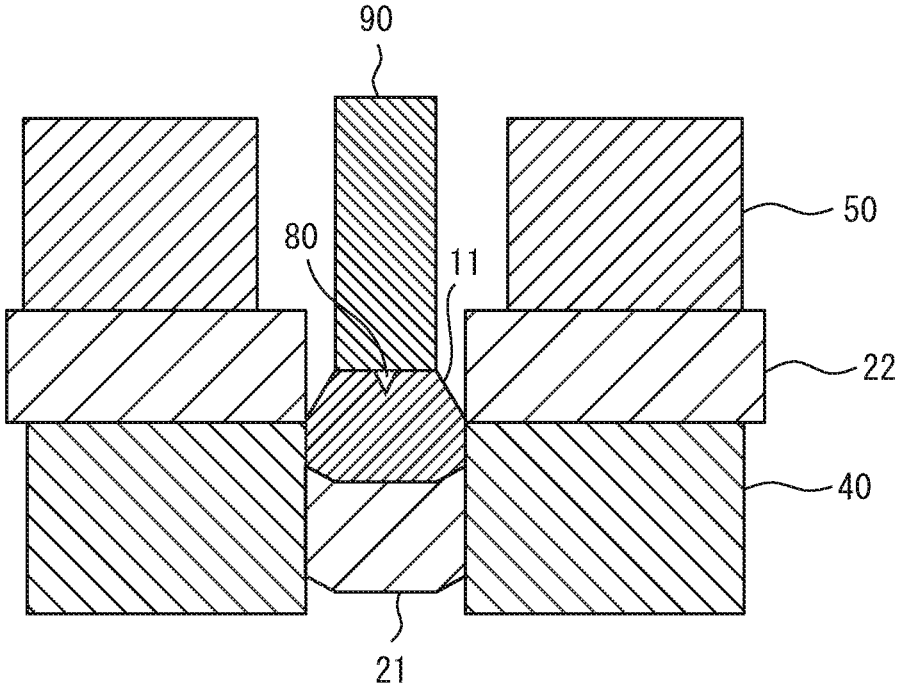
FIG. 34 is a cross-sectional schematic view showing an Embodiment 12 of the present method.

In FIGS. 33 and 34, the first punched out material 11 fastened to the punching surface of the first punch 90 by engagement of the projecting parts 80 is used as a second punch to shear the second blank 20 (second shearing) to obtain the second punched out material 21 and the second worked material 22.

If providing the projecting parts 80 at the punching surface of the first punch 90, the first punched out material 11 is fastened at the punching surface of the first punch 90, so if using the first punched out material 11 as the second punch, it is possible to easily position the first punched out material 11 with respect to the inside diameter of the first die 40 in the direction perpendicular to the punching direction.

Embodiment 13

Figure 35:
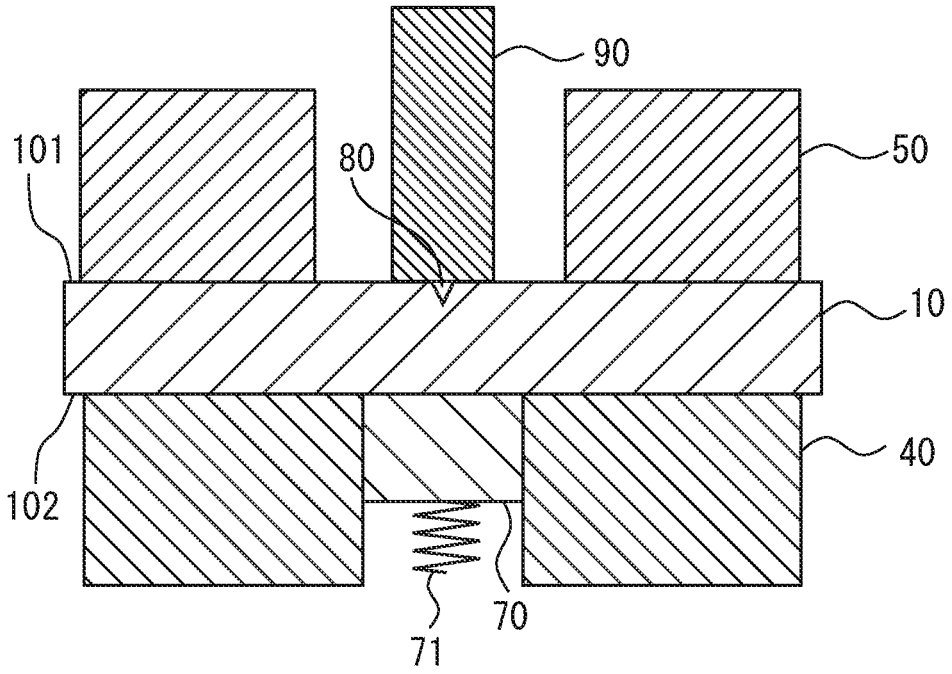
FIG. 35 is a cross-sectional schematic view showing an Embodiment 13 of the present method.

A first punch provided with projecting parts and a back holder arranged at the second surface side of the first blank so as to face the first punch can be used to sandwich and fasten the first blank while shearing it to obtain the first punched out material and the first worked material. FIG. 35 shows another embodiment of shearing of the present method.

In FIG. 35, the first blank 10 is sandwiched by the first punch 90 provided with the projecting parts 80 at the punching surface and the back holder 70 arranged at the second surface 102 side of the first blank 10 so as to face the first punch 90. The first blank 10 is sheared (first shearing) while making the projecting parts 80 bite into the first surface 101 of the first blank 10 to obtain the first punched out material and the first worked material. The back holder 70 is preferably held by an elastic member 71.

FIG. 35 shows an embodiment additionally using the back holder 70 for the shearing shown in FIG. 31. Due to the back holder 70, it is possible to sandwich and fasten the first blank 10 by the punching surface of the first punch 90 provided with the projecting parts 80 and the back holder 70, so even after punching, the first punched out material can be sandwiched and fastened. For this reason, it is possible to prevent the first punched out material from being detached from the punching surface of the first punch 90 provided with the projecting parts 80. After the shearing shown in FIG. 35, the first punched out material can be fastened sandwiched by the punching surface of the first punch 90 provided with the projecting parts 80 and the back holder 70 while, in the same way as the embodiment shown in FIGS. 32 to 34, the first blank 10 and the second blank 20 are sheared (second shearing).

Embodiment 14

A first die provided with projecting parts at the surface contacting the second surface of the blank (below, also referred to as the "holding surface") can be used to shear the first blank while making the projecting parts bite into the second surface of the first blank so as to obtain a punched out material and worked material. Next, the worked material fastened to the holding surface of the first die by the engagement of the projecting parts can be used as the second die to shear the second blank (second shearing) to obtain a second punched out material and second worked material. FIGS. 36 to 39 show another embodiment of shearing of the present method.

Figure 36:
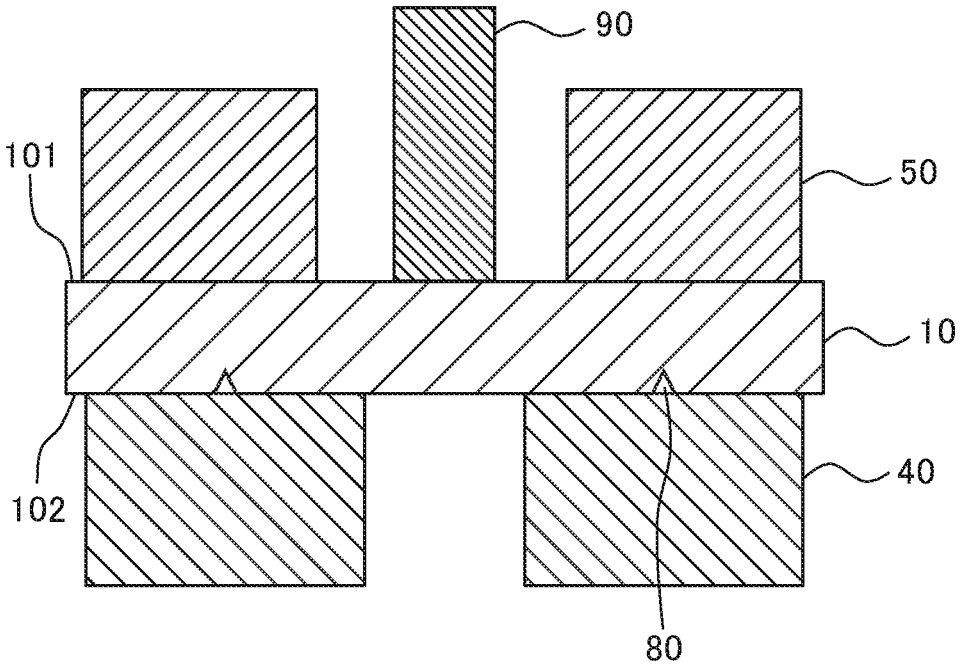
FIG. 36 is a cross-sectional schematic view showing an Embodiment 14 of the present method.
Figure 37:
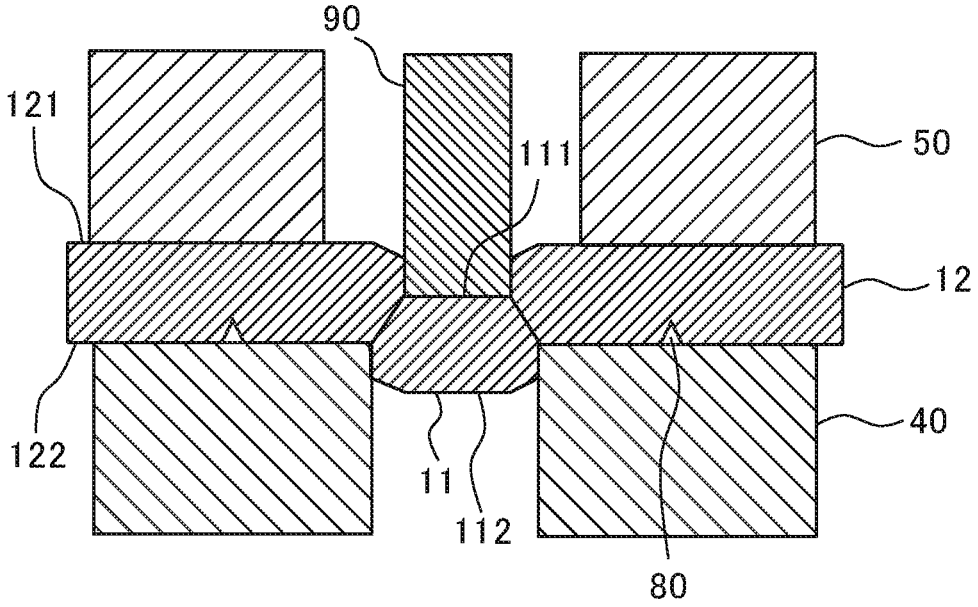
FIG. 37 is a cross-sectional schematic view showing an Embodiment 14 of the present method.

In FIGS. 36 and 37, the first die 40 provided with projecting parts 80 at the holding surface is used to shear the first blank (first shearing) while making the projecting parts 80 bite into the second surface of the first blank to obtain the first punched out material 11 and the first worked material 12 fastened to the holding surface of the first die 40 by the engagement of the projecting parts 80.

Figure 38:
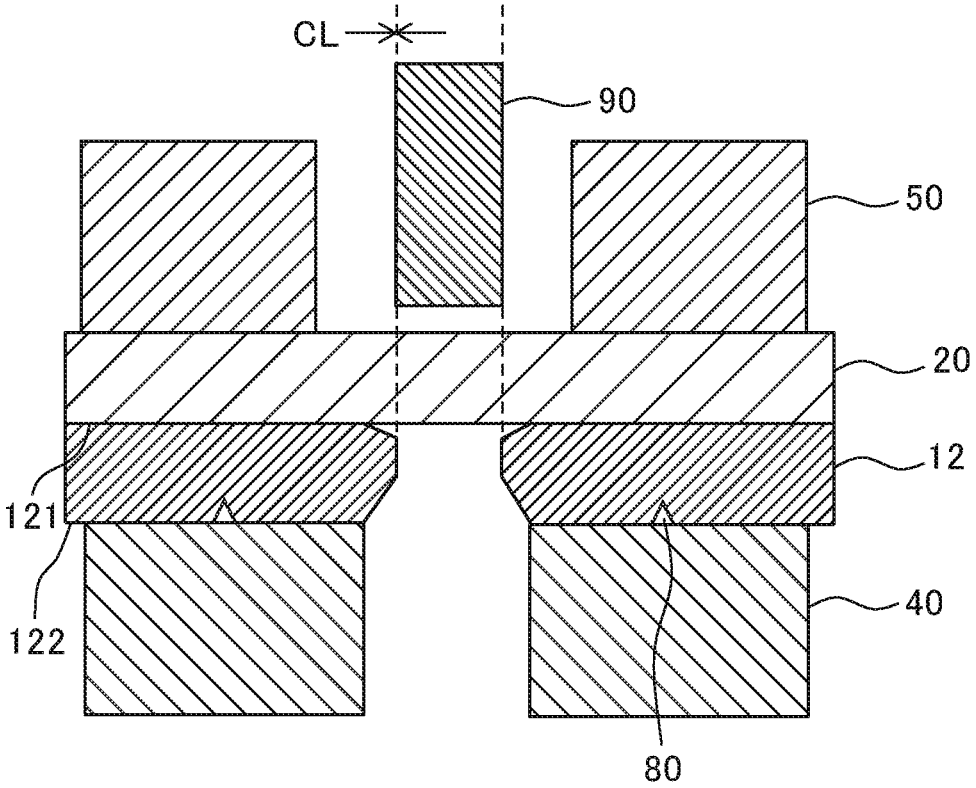
FIG. 38 is a cross-sectional schematic view showing an Embodiment 14 of the present method.
Figure 39:
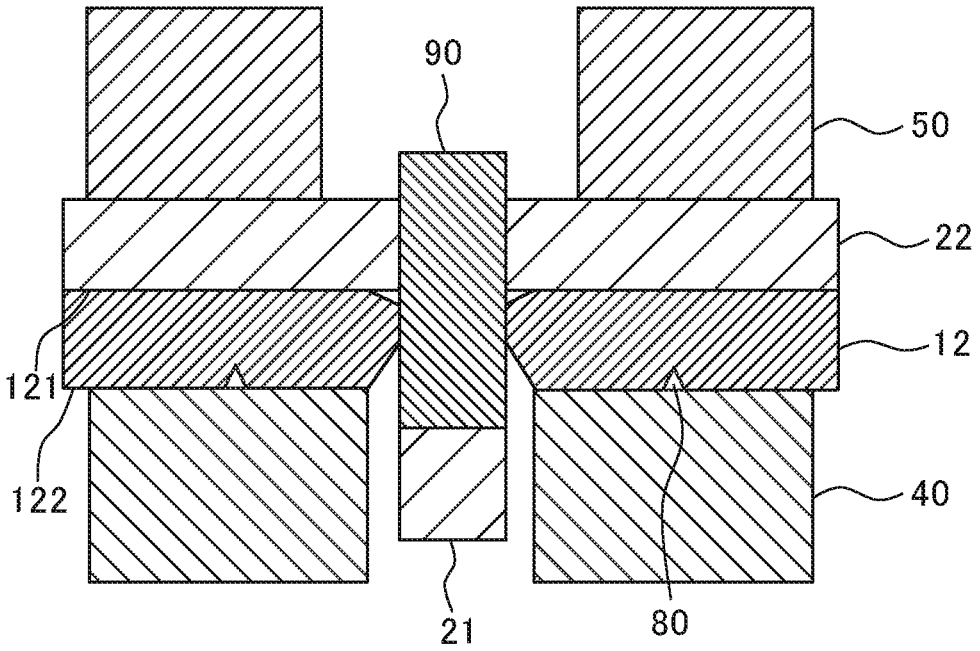
FIG. 39 is a cross-sectional schematic view showing an Embodiment 14 of the present method.

FIGS. 38 and 39 show using the worked material 12 fastened to the holding surface of the first die 40 by engagement of the projecting parts 80 as the second die to shear the second blank 20 (second shearing) to obtain the second punched out material 21 and the second worked material 22.

If providing the projecting parts 80 at the holding surface of the first die 40, the first worked material 12 is fastened to the first die 40, so if using the first worked material 12 as the second die, it is possible to easily position the first worked material 12 with respect to the first punch 90.

In the embodiments illustrated in FIGS. 36 to 39, a holder 50 may be used or may not be used, but preferably a holder 50 is used. It is possible to sandwich and fasten the first blank 10 between the holder 50 and the first die 40 and sandwich and fasten the first worked material 12 even after being punched. For this reason, it is possible to prevent the first worked material 12 from detaching or deviating in position from the holding surface of the first die 40 provided with the projecting parts 80.

The embodiment illustrated in FIGS. 31 to 35 and the embodiment illustrated in FIGS. 36 to 39 may be combined.

The shape of the projecting parts may be any one which can restrain the blank. It may be a projection, relief, surface treated surface, or other shape increasing the frictional resistance. The method of forming the projection, relief, or surface treated surface is not particularly limited, but for example can be made as follows: A projection can be formed by embedding a pin having a projecting shape at its tip. The relief can be formed by cutting to form 10 μm to 500 μm grooves in the surface contacting the steel sheet. The surface treated surface can be formed by sandblasting or another method of increasing the frictional resistance.

The height of the projecting parts in the sheet thickness direction of the blank is preferably 10 to 500 μm. The circle equivalent diameter of the projecting parts in the direction perpendicular to the sheet thickness direction of the blank is preferably 10 to 500 μm. The higher the height of the projecting parts, the stronger the restraining force can be made, but the projecting parts easily become greater in wear. Further, the load necessary for biting into the blank becomes greater. The smaller the circle equivalent diameter of the projecting parts, the smaller the load necessary for making the projecting parts bite into the blank, but the projecting parts easily become greater in wear. The smaller the number of the projecting parts (density), the smaller the load necessary for making them bite into the blank, but the restraining force is weakened.

Embodiment 15

Figure 40:
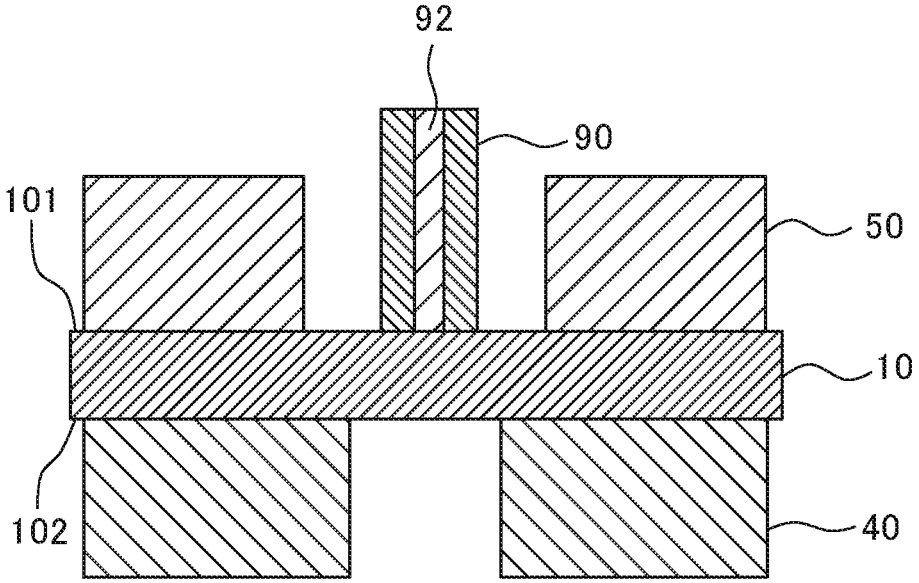
FIG. 40 is a cross-sectional schematic view showing an Embodiment 15 of the present method.

Part of the first punch may also be provided with electromagnets. FIG. 40 shows another embodiment of shearing of the present method. FIG. 40 shows a mode of shearing using a first punch 90 provided with an electromagnet 92 at part. By arranging the electromagnet 92 inside the first punch 90, it is possible to draw the first blank and the first punched out material together by the electromagnetic force and, in the same way as the case of providing the projecting parts at the first punch, possible to easily position the first punched out material used as the second punch.

Figure 41:
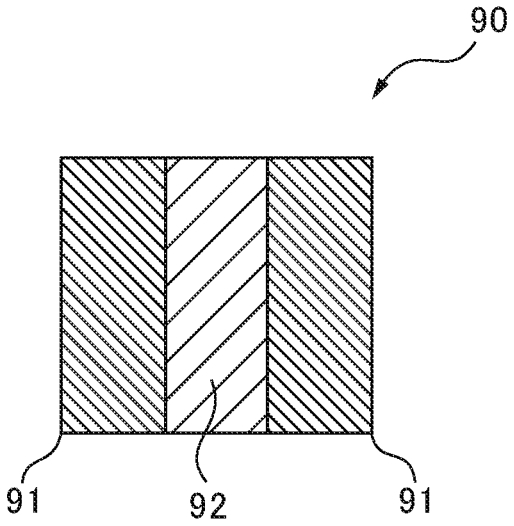
FIG. 41 is a cross-sectional schematic view of a punch provided with an electromagnet.
Figure 42:
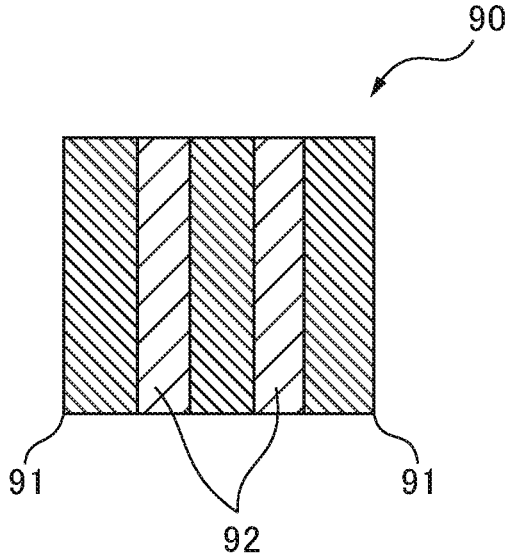
FIG. 42 is a cross-sectional schematic view of a punch provided with electromagnets.

The electromagnet 92 in the first punch 90 may be arranged at a desired position other than the blade 91. FIGS. 41 and 42 show cross-sectional schematic views of the first punch 90 with different arrangements of electromagnets 92. The first punch 90 is preferably provided with two or more electromagnets 92. By the first punch 90 being provided with two or more electromagnets 92, it is possible to suppress more the drop off or deviation of the blank and punched out material due to the effect of momentum. The first punch 90 of FIG. 41 includes one electromagnet 92 inside it, while the first punch 90 of FIG. 42 includes two electromagnets 92 inside it. For this reason, the first punch 90 of FIG. 42 suppresses drop-off and deviation of the blank and punched out material more than the first punch 90 of FIG. 41. However, the first punch 90 should be small in dimension in the direction perpendicular to the punching direction so as to reduce the scrap and improve the yield. The number of the electromagnets 92 is preferably two to four.

The material of the electromagnets is not particularly limited so long as one able to fasten the blank and punched out material, but the electromagnets preferably have a maximum attraction force of 50N or more per 1 kg weight of punched out material, more preferably 500N or more per 1 kg weight of punched out material. The shapes of the electromagnets are not particularly limited so long as ones arranged at the inside of the first punch and able to fasten the blank, but preferably they have substantially columnar shapes concentric with the first punch. For example, it is possible to use round electromagnets FSGP® made by Fujita.

The first punch may be provided with electromagnets and have the above projecting parts at the punching surface and may be combined with the above back holder.

The first die may be provided with electromagnets. Even in this case, it is possible to use the magnetic force to pull together the blank and worked material and, in the same way as the case of providing the projecting parts at the first die, possible to easily position the worked material used as the second die.

Embodiment 16

Figure 43:
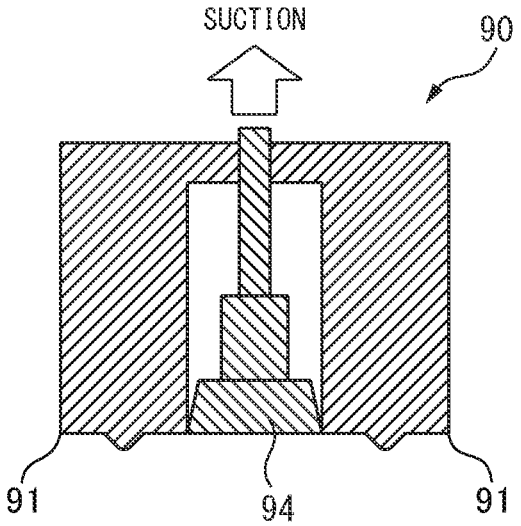
FIG. 43 is a cross-sectional schematic view of a punch provided with a suction part.
Figure 44:
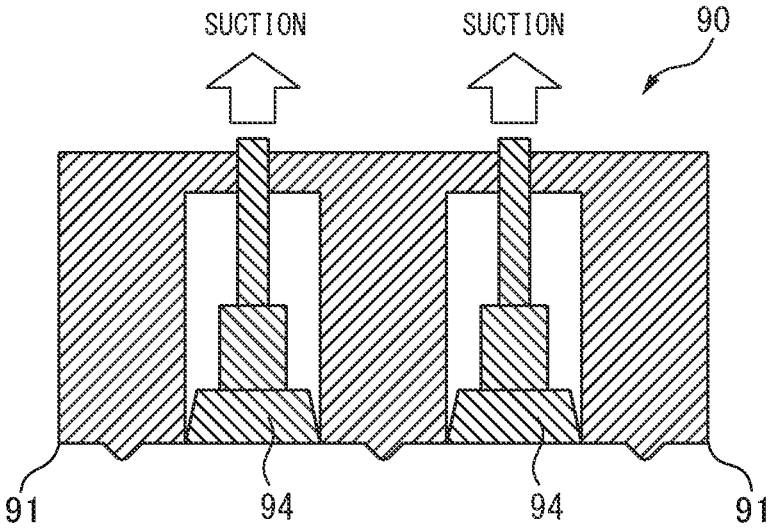
FIG. 44 is a cross-sectional schematic view of a punch provided with suction parts.

Part of the first punch may also be provided with suction parts. FIGS. 43 and 44 show cross-sectional schematic views of the first punch 90 provided with suction parts 94 inside it. By arranging the suction parts 94 at the inside of the first punch 90, it is possible to pull against the blank by suction. In the same way as the case of providing projecting parts at the first punch or the first die, it is possible to easily position the first punched out material used as the second punch.

The suction part 94 in the first punch 90 can be placed at a desired position other than the blade 91. The first punch 90 is preferably provided with two or more suction parts 94. By the first punch 90 being provided with two or more suction parts 94, it is possible to suppress more the drop off or deviation of the blank and punched out material due to the effect of momentum.

The first punch 90 of FIG. 43 includes one suction part 94 at the inside, while the first punch 90 of FIG. 44 includes two suction parts at the inside. For this reason, the first punch 90 of FIG. 44 can suppress drop off or deviation of the blank and punched out material more than the first punch 90 of FIG. 43. However, the first punch 90 should be small in dimension in the direction perpendicular to the punching direction so as to reduce the scrap and improve the yield. The number of the suction parts 94 is preferably two to four.

The configuration of the suction parts 94 is not particularly limited so long as able to fasten the blank and punched out material, but the suction parts 94 preferably have a maximum suction force of 50N or more per 1 kg weight of punched out material, more preferably 500N or more per 1 kg weight of punched out material. The shape of the suction parts 94 is not particularly limited so long as the parts are arranged at the inside of the first punch 90 and can fasten the blank, but, for example, it is possible to use Freeholder® made by Nihon Pisco.

The first punch may be provided with suction parts at part and have projecting parts on the punching surface. It may also be combined with the above back holder.

The first die may be provided with suction parts. In this case as well, the blank and worked material can by pulled against by suction force. In the same way as when providing the projecting parts at the first die, it is possible to easily position the worked material used as the second die.

The present method can be performed by combining as desired embodiments selected from at least one of the Embodiments 10 to 16, any one of the Embodiments 1 to 8, and the Embodiment 9.

The blank has a hole expansion rate $\lambda$ of preferably over 1%, more preferably over 5%, still more preferably over 10%. By having the above range of hole expansion rate $\lambda$, a longer burnished surface can be obtained. If using a first punch including electromagnets, the blank is a material attracted by electromagnetic force.

As explained above, the present method has as its basic idea to use the punched out material as a punch in the punched out state or inverted from the punched out state and/or to use the worked material as a die in the punched state or inverted from the punched state.

In the present method, in this way, the punched out material is used as a punch and/or the worked material is used as a die, so the wear and damage of the first punch and/or the first die can be reduced and the clearance CL can be reduced. Preferably it can be made about 0 mm, so it is possible to form a sheared edge excellent in surface perpendicularity and surface properties at the worked material.

The present disclosure further covers a shearing apparatus. The present apparatus is a shearing apparatus having a punch and a die for shearing a blank and shearing the blank to obtain a punched out material and a worked material. The shearing apparatus is provided with a first punch and a first die. The shearing apparatus has a punched out material reutilization mechanism, a worked material reutilization mechanism, or both mechanisms. The punched out material reutilization mechanism is a mechanism using a first punched out material obtained by shearing a first blank by the first punch and a first die as the second punch when shearing the second blank. The worked material reutilization mechanism is a mechanism using a first worked material obtained by shearing the first blank by the first punch and the first die as a second die when shearing the second blank.

The configuration of the punched out material reutilization mechanism is not limited so long as having a mechanism for using the first punched out material as the second punch when shearing the second blank. Similarly, the configuration of the worked material reutilization mechanism is not limited so long as having a mechanism for using the first worked material as the second die when shearing the second blank. The configurations of the punched out material reutilization mechanism and worked material reutilization mechanism preferably may have configurations selected from a configuration corresponding to at least one of the Embodiments 10 to 16 of the shearing method, a configuration corresponding to any one of the Embodiments 1 to 8, and a configuration corresponding to the Embodiment 9 in the desired combination.

The shearing apparatus can be provided with a first punch, a first die, a blank placement mechanism able to automatically place the first blank at the shearing part, a punched out material reutilization mechanism placing the first punched out material obtained by the first shearing at a scheduled punching location at the first punch side of the second shearing performed next, and a worked material reutilization mechanism placing the first worked material obtained by the first shearing at a scheduled punching location at the first die side of the second shearing performed next.

The shearing apparatus preferably is provided with a first punch and back holder able to sandwich and fasten the first blank and a first die and holder.

The punched out material reutilization mechanism preferably is provided with a robot arm for placing the first punched out material obtained in the first shearing at a scheduled punching location of the first punch side of the second shearing performed next.

The punched out material reutilization mechanism preferably includes at least one of a first punch having projecting parts at the punching surface and a first punch provided with electromagnets or suction parts. The first punch having projecting parts at the punching surface can bite into the first blank and the first punched out material by the projecting parts to hold the first punched out material at the punching surface of the first punch. The first punch provided with electromagnets or suction parts can pull the first blank and the first punched out material to the punching surface of the first punch to hold them.

The worked material reutilization mechanism is preferably provided with a robot arm for placing the first worked material obtained by the first shearing at the scheduled punching location of the first die side of the second shearing performed next.

The worked material reutilization mechanism preferably includes at least one of a first die having projecting parts at a holding surface and a first die provided with electromagnets or suction parts.

The worked material reutilization mechanism further can place the first worked material obtained by the first shearing as a holder for the second shearing to be performed next. The worked material reutilization mechanism is preferably provided with a robot arm for placing the first worked material at the holder part.

The punched out material reutilization mechanism and worked material reutilization mechanism preferably can place the first punched out material and the first worked material after the first shearing, without separating them, at the scheduled punching location and holder location of the first punch side of the second shearing performed next.

The shearing apparatus may be provided with a punched out material takeout mechanism for removing the first punched out material instead of a punched out material reutilization mechanism. The punched out material takeout mechanism has a configuration similar to the punched out material reutilization mechanism except for taking out and ejecting the first punched out material. The shearing apparatus may be further provided with a worked material takeout mechanism for taking out the first worked material instead of the worked material reutilization mechanism. The worked material takeout mechanism has a configuration similar to the worked material reutilization mechanism except for taking out and ejecting the first worked material.

In addition, the above description explaining the configuration of the shearing method can also be applied to the configuration of the present apparatus.

Examples

Next, examples of the present invention will be explained. The conditions in the examples are an illustration of conditions employed for confirming the workability and effects of the present invention. The present invention is not limited to this illustration of conditions. The present invention can employ various conditions without departing from the gist of the present invention so long as achieving the object of the present invention.

A diameter 10.00 mm first punch and inside diameter 10.32 mm first die were used to shear a first steel sheet having a 1.6 mm thickness and having a tensile strength of 1180 MPa to obtain a first punched out material and first worked material. The obtained first punched out material was used as a second punch and/or the obtained first worked material was used as a second die to shear a second steel sheet having a 1.6 mm thickness and having a tensile strength of 1180 MPa to obtain a second punched out material and second worked material.

Figure 45:
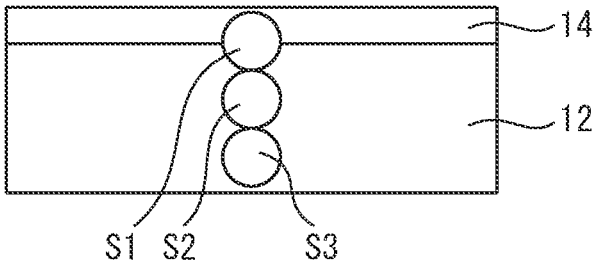
FIG. 45 is a schematic view showing a measurement position of residual stress at a sheared edge.

Specifically, in the first shearing method (conventional shearing method) shown in FIGS. 5 and 6, the first steel sheet was sheared to obtain the first worked material. Further, after the first steel sheet was sheared to obtain the first worked material, the second shearing method shown in the Embodiments 1 to 8 shown in FIGS. 7 and 8, FIGS. 9 and 10, FIGS. 11 and 12, FIGS. 13 and 14, FIGS. 15 and 16, FIGS. 17 and 18, FIGS. 19 and 20, and FIGS. 21 and 22 was used to shear the second steel sheet to obtain the second worked material. The first worked material and the second worked material were cut on the line passing through the centers of the punched holes in parallel in the sheet thickness direction to observe the surface perpendicularity of the sheared edge. The average tensile residual stresses of the sheared edges of the first worked material and the second worked material were measured by firing spot diameter 500 μm X-rays using the $\sin^2{}_\psi$ method. FIG. 45 shows the measurement locations of the average residual stress of the first worked material 12. There are three measurement locations of the average residual stress of S1 (burnished surface side), S2 (sheet thickness center), and S3 (burr side) along the sheet thickness direction of the first worked material 12 from the top of FIG. 45. For the second worked material as well, the average residual stress of the three locations of S1 (burnished surface side), S2 (sheet thickness center), and S3 (burr side) was measured in the same way.

Figure 46:
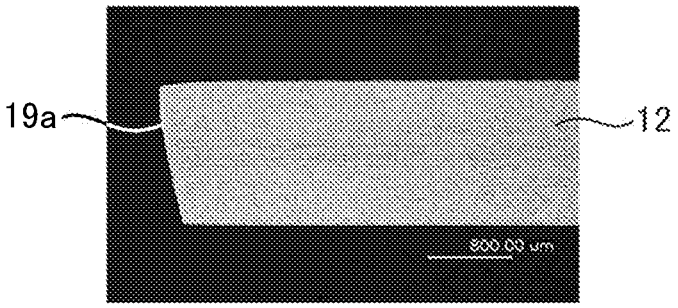
FIG. 46 is a cross-sectional photograph of a first worked material obtained by shearing by the prior art.
Figure 47:
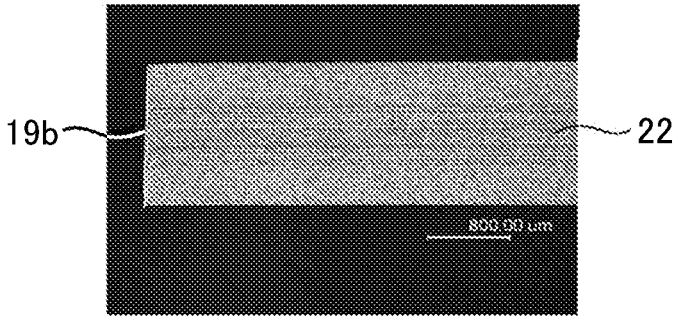
FIG. 47 is a cross-sectional photograph of a second worked material obtained by shearing by an Embodiment 1.
Figure 48:
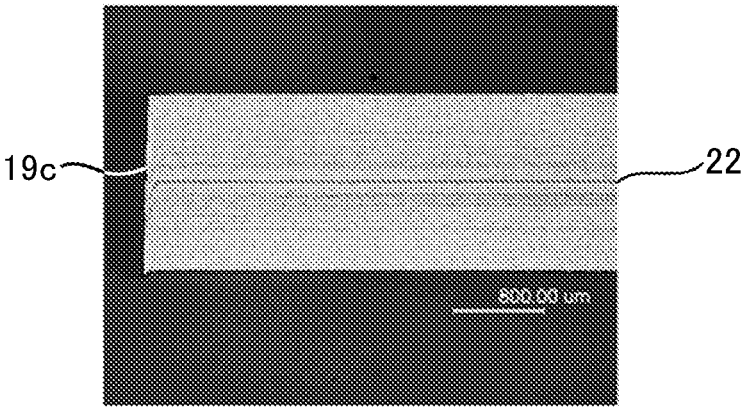
FIG. 48 is a cross-sectional photograph of a second worked material obtained by shearing by an Embodiment 2.
Figure 49:
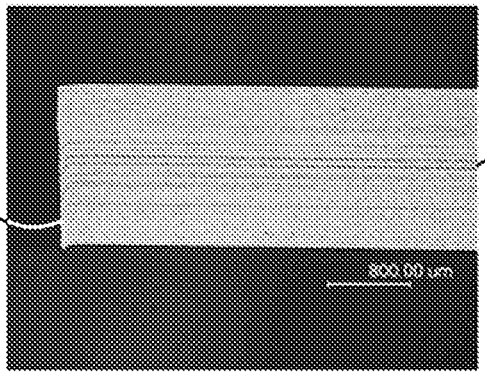
FIG. 49 is a cross-sectional photograph of a second worked material obtained by shearing by an Embodiment 5.
Figure 50:
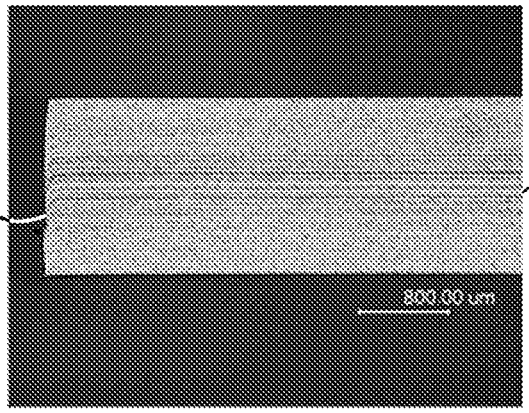
FIG. 50 is a cross-sectional photograph of a second worked material obtained by shearing by an Embodiment 6.

FIG. 46 shows a cross-sectional photograph of the first worked material 12 obtained by shearing the first steel sheet by the mode shown in FIGS. 5 and 6 (first shearing, prior art). FIGS. 47 to 50 shows cross-sectional photographs of second worked materials 22 obtained by shearing the second steel sheets by the methods shown in the Embodiments 1, 2, 5, and 6.

As shown in FIG. 46, the sheared edge 19*a* of the first worked material 12 sheared by the conventional method was slanted, while as shown in FIGS. 47 to 50, the surface perpendicularities of the sheared edges 19*b* to 19*e* of the second worked material 22 sheared by the methods shown in the Embodiments 1, 2, 5, and 6 were excellent.

Figure 51:
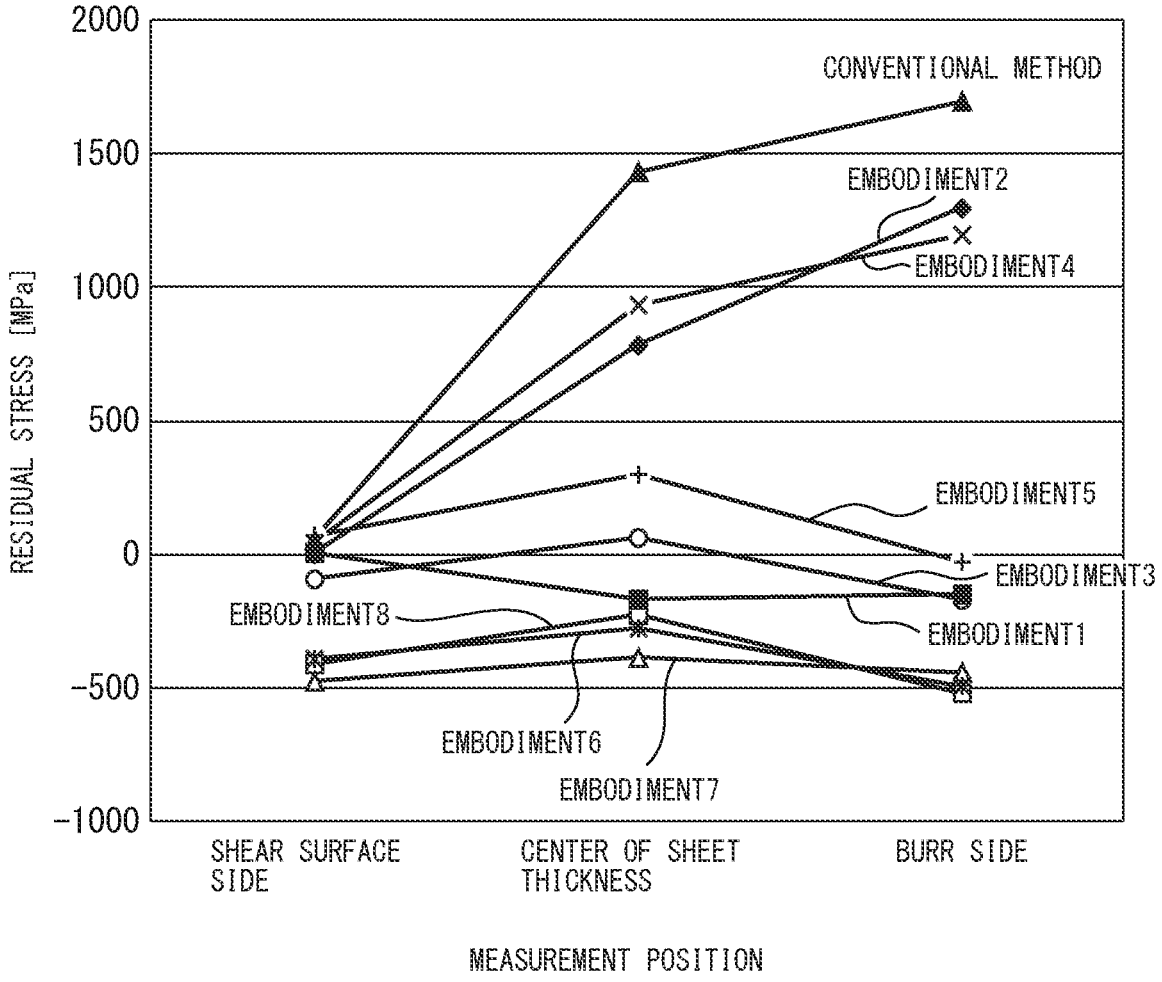
FIG. 51 is a graph measuring the average residual stress of a sheared edge of a second worked material.

FIG. 51 shows the results of measurement of the average tensile residual stresses of the sheared edges of the first worked material obtained by the prior art and second worked materials obtained by the methods shown in the Embodiments 1 to 8. If using the punched out material as a punch and/or using the worked material as a die, compared with the case of conventional shearing, the average residual stress at the sheared edge of the worked material is reduced. From this, it will be understood that excellent fatigue resistance characteristics and hydrogen embrittlement resistance can be obtained. In particular, the average residual stresses of the worked materials obtained by the methods shown in the Embodiments 1, 3, 5, and 6 to 8 were small. Further, the average residual stresses at the sheared edges of the worked materials obtained by the methods shown in the Embodiments 1 and 6 to 8 were the compression side. If the residual stress at the sheared edge is the compression side, at the sheared edge, it is possible to secure particularly excellent fatigue resistance characteristics and hydrogen embrittlement resistance.

It is learned that the surface perpendicularity and surface properties of the sheared edge formed using the punched out material as a punch and/or using the worked material as a die are better than a sheared edge formed by a conventional stamping method.

REFERENCE SIGNS LIST

10. first blank
101. first surface of first blank
102. second surface of first blank
11. first punched out material
11'. first inverted punched out material
111. first surface of first punched out material
112. second surface of first punched out material
12. first worked material
12'. first inverted worked material
121. first surface of first worked material
122. second surface of first worked material
14. shear droop
14'. shear droop
15. burnished surface
15'. burnished surface
16. fracture surface
16'. fracture surface
17. burr
17'. burr
18*a*. punch side surface
18*b*. die side surface
19. sheared edge
19*a*, 19*b*, 19*c*, 19*d*, 19*e*. sheared edge
20. second blank
201. first surface of second blank
202. second surface of second blank
21. second punched out material
22. second worked material
30. third blank
301. first surface of third blank
302. second surface of third blank
31. third punched out material
32. third worked material
40. die
50. holder
60. fastening jig
70. back holder
71. elastic member
80. projecting part
90. punch
90*a*. sheet thickness direction of blank
91. blade
92. electromagnet
94. suction part
CL. clearance between punch and die
S1, S2, S3. measurement locations of residual stress

The invention claimed is:

1. A shearing method of shearing a blank by a die and a punch, characterized by comprising:

a first shearing step of placing, on a first die, a first blank having a first surface and a second surface on an opposite side to the first surface so that said second surface is arranged on said first die side, and shearing said first blank from said first surface toward said second surface in a sheet thickness direction of said first blank by a first punch arranged at said first surface side to obtain a first punched out material and a first worked material each having a first surface and a second surface corresponding to the first surface and the second surface of said first blank; and a second shearing step of placing a second blank and shearing said second blank to obtain a second punched out material and a second worked material by (x) using said first punched out material as a second punch, (y) using said first worked material as a second die, or (z) using said first punched out material as a second punch and using said first worked material as a second die.

2. The shearing method according to claim 1 characterized in that, in said second shearing step, said first punched out material is placed so that the second surface of said first punched out material faces said second blank and so that the first surface of said first punched out material is arranged at said first punch side, and said first punched out material is used as said second punch to shear said second blank to obtain the second punched out material and the second worked material.

3. The shearing method according to claim 2 characterized in that, in said second shearing step, said first worked material is placed so that the first surface of said first worked material faces said second blank and so that the second surface of said first worked material is arranged at said first die side, and said first worked material is used as said second die to shear said second blank to obtain the second punched out material and the second worked material.

4. The shearing method according to claim 2 characterized in that, in said second shearing step, said first worked material is placed so that the second surface of said first worked material faces said second blank and so that the first surface of said first worked material is arranged at said first die side, and said first worked material is used as said second die to shear said second blank to obtain the second punched out material and the second worked material.

5. The shearing method according to claim 2 characterized in that, in said second shearing step, a clearance between the punch used for said second blank and the die used for said second blank in a direction perpendicular to a sheet thickness direction of said second blank is about 0 mm.

6. The shearing method according to claim 2, characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

7. The shearing method according to claim 1 characterized in that, in said second shearing step, said first punched out material is placed so that the first surface of said first punched out material faces said second blank and so that the second surface of said first punched out material is arranged at said first punch side, and said first punched out material is used as said second punch to shear said second blank to obtain the second punched out material and the second worked material.

8. The shearing method according to claim 7 characterized in that, in said second shearing step, said first worked material is placed so that the first surface of said first worked material faces said second blank and so that the second surface of said first worked material is arranged at said first die side, and said first worked material is used as said second die to shear said second blank to obtain the second punched out material and the second worked material.

9. The shearing method according to claim 7 characterized in that, in said second shearing step, said first worked material is placed so that the second surface of said first worked material faces said second blank and so that the first surface of said first worked material is arranged at said first die side, and said first worked material is used as said second die to shear said second blank to obtain the second punched out material and the second worked material.

10. The shearing method according to claim 7 characterized in that, in said second shearing step, a clearance between the punch used for said second blank and the die used for said second blank in a direction perpendicular to a sheet thickness direction of said second blank is about 0 mm.

11. The shearing method according to claim 7, characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

12. The shearing method according to claim 1 characterized in that, in said second shearing step, said first worked material is placed so that the first surface of said first worked material faces said second blank and so that the second surface of said first worked material is arranged at said first die side, and said first worked material is used as said second die to shear said second blank to obtain the second punched out material and the second worked material.

13. The shearing method according to claim 12 characterized in that, in said second shearing step, a clearance between the punch used for said second blank and the die used for said second blank in a direction perpendicular to a sheet thickness direction of said second blank is about 0 mm.

14. The shearing method according to claim 12, characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

15. The shearing method according to claim 1 characterized in that, in said second shearing step, said first worked material is placed so that the second surface of said first worked material faces said second blank and so that the first surface of said first worked material is arranged at said first die side, and said first worked material is used as said second die to shear said second blank to obtain the second punched out material and the second worked material.

16. The shearing method according to claim 15 characterized in that, in said second shearing step, a clearance between the punch used for said second blank and the die used for said second blank in a direction perpendicular to a sheet thickness direction of said second blank is about 0 mm.

17. The shearing method according to claim 15, characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

18. The shearing method according to claim 1 characterized in that, in said second shearing step, a clearance between the punch used for said second blank and the die used for said second blank in a direction perpendicular to a sheet thickness direction of said second blank is about 0 mm.

19. The shearing method according to claim 1, characterized by further comprising a third shearing step of shearing a third blank to obtain a third punched out material and a third worked material by (x) using said second punched out material as a third punch, (y) using said second worked material as a third die, or (z) using said second punched out material as a third punch and using said second worked material as a third die.

20. A shearing apparatus having a punch and a die for shearing a blank and shearing said blank to obtain a punched out material and a worked material, the shearing apparatus comprising a first punch and a first die, characterized in that said shearing apparatus further comprises:

a punched out material reutilization mechanism using a first punched out material obtained by shearing a first blank by said first punch and first die as a second punch when shearing a second blank, a worked material reutilization mechanism using a first worked material obtained by shearing a first blank by said first punch and first die as a second die when shearing a second blank, or a punched out material reutilization mechanism using a first punched out material obtained by shearing a first blank by said first punch and first die as a second punch when shearing a second blank and a worked material reutilization mechanism using a first worked material obtained by shearing a first blank by said first punch and first die as a second die when shearing a second blank.

* * * * *